US011326852B2

(12) United States Patent
Morenz et al.

(10) Patent No.: US 11,326,852 B2
(45) Date of Patent: May 10, 2022

(54) FOLDING STOCK ASSEMBLY WITH LOCKING MECHANISM

(71) Applicant: Sig Sauer, Inc., Newington, NH (US)

(72) Inventors: Luke E. Morenz, Dover, NH (US); Tanner J. Landis, Dover, NH (US); Samuel D. Beck, Atkinson, NH (US); David B. Hopkins, Exeter, NH (US); Timothy V. Blazek, Barrington, NH (US)

(73) Assignee: Sig Sauer, Inc., Newington, NH (US)

( * ) Notice: Subject to any disclaimer, the term of this patent is extended or adjusted under 35 U.S.C. 154(b) by 104 days.

(21) Appl. No.: 17/072,610

(22) Filed: Oct. 16, 2020

(65) Prior Publication Data

US 2021/0222993 A1 Jul. 22, 2021

Related U.S. Application Data

(60) Provisional application No. 62/916,326, filed on Oct. 17, 2019.

(51) Int. Cl.
*F41C 23/04* (2006.01)

(52) U.S. Cl.
CPC ..... *F41C 23/04* (2013.01)

(58) Field of Classification Search
CPC ..... F41C 23/04; F41C 23/14; F41C 27/06; F41A 3/84; F41A 11/02; F41A 3/66; F41A 11/04; F41A 19/10; F41A 3/26; F41A 35/06
USPC ..... 42/73, 1.06, 71.01, 72, 74, 71.02, 42/75.01–75.1; 89/191.01, 193, 198
See application file for complete search history.

(56) References Cited

U.S. PATENT DOCUMENTS

| | | | | |
|---|---|---|---|---|
| 7,673,412 | B2 | 3/2010 | Griffin | |
| 9,664,478 | B2 | 5/2017 | Robinson et al. | |
| 10,156,421 | B2 | 12/2018 | Smith et al. | |
| 10,746,493 | B1 * | 8/2020 | Steimke | F41A 9/29 |
| 11,268,784 | B1 * | 3/2022 | Lee | F41C 23/04 |
| 11,268,785 | B1 * | 3/2022 | Lee | F41C 23/04 |

(Continued)

OTHER PUBLICATIONS

Heinrich Kipp Werk GmbH & Co., K1285 Cam-action indexing plungers with stop, https://www.kipp.com/gb/en/Products/Operating-parts-standard-elements/Spring-plungers-indexing-plungers-ball-lock-pins/Cam-action-indexing-plungers-with-stop-stainless-steel.html (Accessed Sep. 29, 2020).

(Continued)

*Primary Examiner* — Michael D David
(74) *Attorney, Agent, or Firm* — Finch & Maloney, PLLC

(57) ABSTRACT

A hinge joint includes first and second hinge leaves pivotably mounted on a hinge pin, where the hinge joint is operable between open and closed positions. The hinge joint has a locking mechanism that prevents opening the hinge joint from a closed position until the locking mechanism is moved to the unlocked position. In one example, the locking mechanism includes a plunger retained in the hinge pin. When the plunger is depressed, one or more protrusions can move from a blocking position to a non-blocking position. In some embodiments, the locking mechanism must be moved to the unlocked position prior to opening the hinge joint. The locking mechanism may be used alone or in combination with engagement structures between the first and second hinge leaves. The hinge joint can be part of a folding rifle stock assembly or other hinged assembly.

20 Claims, 14 Drawing Sheets

(56) References Cited

U.S. PATENT DOCUMENTS

| | | | | |
|---|---|---|---|---|
| 2012/0131838 | A1* | 5/2012 | Edge | F41G 11/006 42/90 |
| 2012/0137561 | A1* | 6/2012 | Ludlow | F41C 23/04 42/75.03 |
| 2016/0084612 | A1* | 3/2016 | Robinson | F41C 23/14 42/73 |
| 2016/0116250 | A1* | 4/2016 | Mather | F41A 3/66 42/73 |

OTHER PUBLICATIONS

Ugly Fish Inc., Southco Mobella Point Cabinet and Compartment Latch, https://www.uglyfishinc.com/southco-marine-cabinet-and-compartment-latches-p/mp-05-xx2-xx.htm (Accessed Sep. 29, 2020).
wixroyd.com, One-Touch Fastener-Cam Locking (Oct. 1, 2017).
Plooij, M. et al., "Review of Locking Devices Used in Robotics," IEEE Robotics and Automation Magazine, vol. 22, No. 1 (Mar. 2015).

* cited by examiner

FOLDING STOCK ASSEMBLY WITH LOCKING MECHANISM

RELATED APPLICATIONS

This application claims the benefit under 35 U.S.C. § 119(e) of U.S. Provisional patent Application No. 62/916,326 titled FOLDING STOCK ASSEMBLY WITH LOCKING MECHANISM, and filed on Oct. 17, 2019, the contents of which are incorporated herein by reference in its entirety.

TECHNICAL FIELD

The present disclosure relates generally to stocks for firearms, and more specifically to a folding stock with a locking mechanism.

BACKGROUND

Firearm design involves a variety of non-trivial challenges, including the design of the firearm stock. The stock is an interface between the shooter and the rifle and transfers recoil from the rifle to the shooter. The stock includes a butt plate constructed to engage the shooter's shoulder and is the primary anchor point of the stock. The stock also has a comb that is constructed to engage the shooter's cheek. The comb may be fixed or adjustable. The shooter uses the butt plate to firmly brace the rifle against the shoulder for stability while aiming. The shooter's cheek contacts the comb while aligning the rifle's sights on a target as part of a sight picture. A good fitting stock facilitates rapid target acquisition and precise shot placement in addition to enhancing the shooter's ability to hold the rifle still for the shot. In some situations, it may be desirable to fold the stock against the side of the receiver for a more compact form of the firearm. Some stocks are constructed to fold, but non-trivial challenges remain.

SUMMARY

One embodiment of the present disclosure is directed to a hinge joint with a locking mechanism. Another embodiment of the present disclosure is directed to a folding stock assembly including the hinge joint and locking mechanism. A further embodiment of the present disclosure is directed to a method of operating a folding rifle stock with a locking mechanism.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
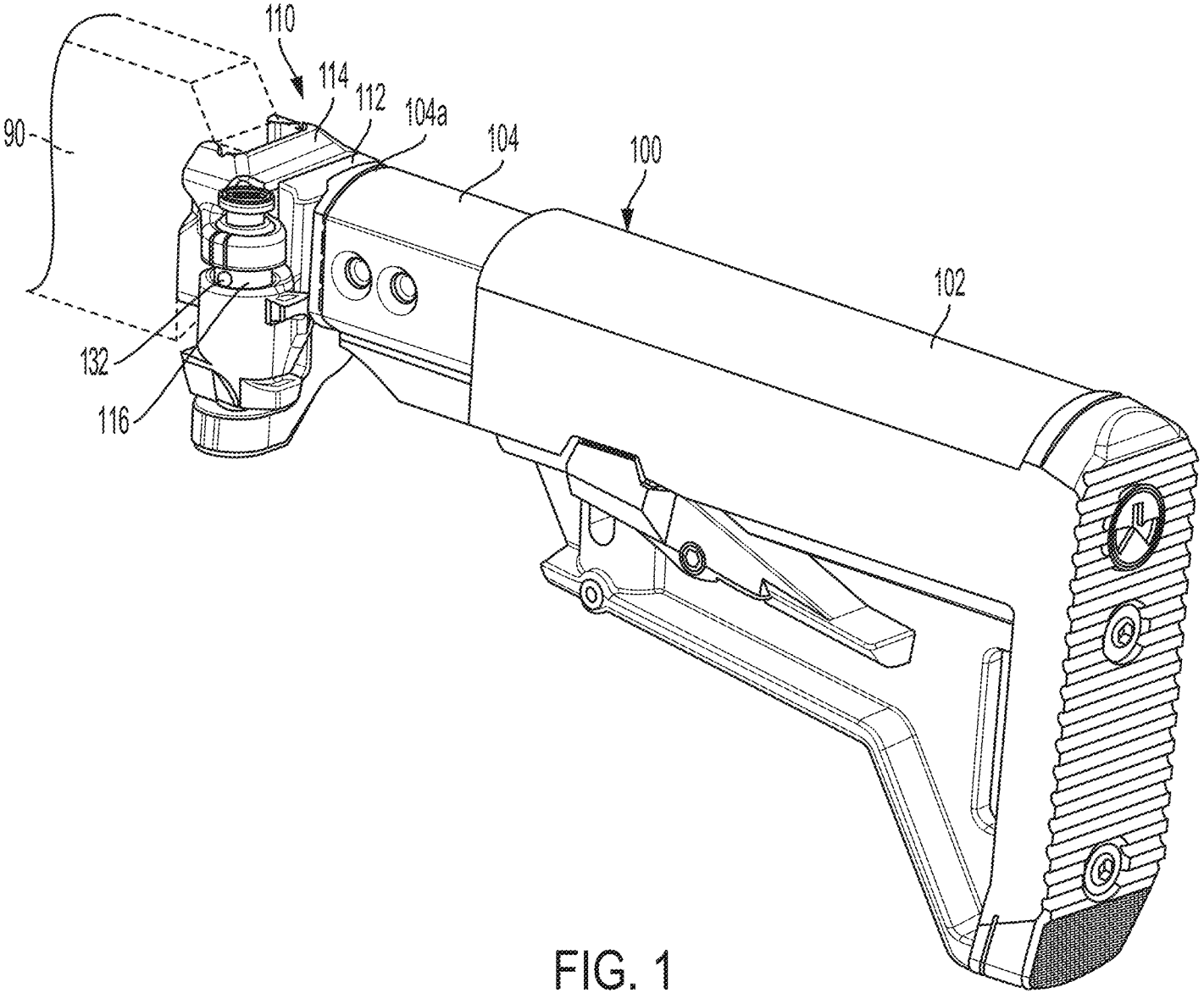
FIG. 1 is a perspective view showing the left, rear, and top sides of a folding stock assembly that includes a hinge joint with a locking mechanism, in accordance with an embodiment of the present disclosure.

The figures depict various embodiments of the present disclosure for purposes of illustration only. These and other features of the present embodiments will be understood better by reading the following detailed description, taken together with the figures herein described. For purposes of clarity, not every component may be labeled in every drawing. Furthermore, as will be appreciated, the figures are not necessarily drawn to scale or intended to limit the claimed invention to the specific configurations shown. Numerous variations, configurations, and other embodiments will be apparent from the following detailed discussion.

DETAILED DESCRIPTION

Disclosed is a hinge joint that includes first and second hinge leaves pivotably mounted on a hinge pin, where the hinge joint is operable between open and closed positions. The hinge joint has a locking mechanism that prevents opening the hinge joint from a closed position until the locking mechanism is moved to the unlocked position. In some embodiments, the locking mechanism automatically returns to the locked condition when the hinge joint is in an open position (e.g., about 180°). In such instances, the locking mechanism is moved to the unlocked position prior to moving the hinge joint from the open position to the closed position (e.g., 0°).

In one example, the locking mechanism includes a plunger or pin that is movably retained in the hinge pin. The plunger is operable to move one or more catches or protrusions (e.g., a steel ball) between blocking and non-blocking positions. For example, the user depresses the plunger against spring pressure to align a recess in the plunger with the protrusions, therefore allowing the protrusions to assume the non-blocking position. When the plunger is in the raised position, it displaces the protrusions so that they extend radially outward from the hinge pin and obstruct movement of the first hinge leaf axially along the hinge pin and/or rotationally about the hinge pin. Accordingly, the locking structure can prevent inadvertent opening and/or closing of a folding rifle stock. In some embodiments, the locking mechanism is combined with another locking mechanism, such as an interlock or overlap between portions of the hinge leaves when the hinge joint is in a closed hinge position. Thus, the locking mechanism can be a secondary locking mechanism that prevents disengagement of overlapping portions of the hinge leaves.

The locking mechanism may be used alone or in combination with engagement structures between the first and second hinge leaves. For example, some hinge joints may include engagement structures that require the first hinge leaf to be translated (e.g., lifted) along the hinge pin with respect to the second hinge leaf to disengage the structures. When disengaged, the hinge leaves achieve a clearance position that permits opening and/or closing of the hinge. In its locked position, for example, the locking structure can prevent inadvertent disengagement of the hinge leaves by blocking the first hinge leaf from translating along the hinge pin. The hinge joint is useful as part of a folding rifle stock assembly constructed to reliably retain the folding stock in the deployed or folded positions. The hinge joint can also be used in other equipment assemblies involving a hinge.

In accordance with one embodiment, a folding rifle stock pivots about a hinge joint between folded and deployed positions. The hinge joint includes two hinge leaves that interlock when the stock is in the deployed position. For example, in the deployed position a bottom edge of the first hinge leaf is received in a slot defined by the second hinge leaf. The hinge leaves can be disengaged by moving the first hinge leaf upward along the hinge pin with respect to the second hinge leaf.

The hinge joint also includes a locking mechanism that blocks the first hinge leaf from translating along the hinge pin, so as to prevent inadvertent disengagement of the hinge leaves. Prior to disengaging the hinge leaves, the user first moves the locking mechanism to an unlocked state. The user can then lift the stock (and first hinge leaf) along the hinge pin to disengage the hinge leaves and allow the stock to pivot. In some embodiments, the locking mechanism returns to a locked state when the stock reaches the folded position, so the locking mechanism must also be moved to an unlocked state prior to deploying the stock. In other embodiments, the locking mechanism remains in an unlocked state while the stock is in the folded position, and therefore does not require unlocking for the user to deploy the stock from the folded position.

In one example embodiment, the locking mechanism has a protrusion that blocks upward movement of one hinge leaf along the hinge pin to the unlocked position until the protrusion is moved. For example, the protrusion is one or more balls or pins that protrude from the hinge pin in a blocking position. In such position, the protrusion(s) obstruct the hinge knuckle from moving vertically along the hinge pin so that the bottom edge of the first hinge leaf can be lifted out of the slot on the second hinge leaf. When the user depresses an actuator such as a button or lever, for example, the protrusions can move into a recess in the hinge pin, removing the obstruction and allowing the hinge knuckle to translate along the hinge pin.

In other embodiments, the locking mechanism can be located on the hinge leaves, such as along mating faces of the hinge leaves, or on some other part of the hinge joint. For example, a plunger or slider moves within one of the hinge leaves to align a recess with one or more protrusions when the locking mechanism is in the unlocked condition. In other positions of the plunger or slider, the protrusions are displaced to protrude from the face of the first hinge leaf and engage a recess in the second hinge leaf, thereby obstructing movement of the first hinge leaf to a position where the leaves can be disengaged and then moved to an open hinge position.

In yet another embodiment, depressing an actuator pivots a catch on one hinge leaf so that it is disengages from a recess in the other hinge leaf. The catch can be a hook or the like that is biased to extend from the first hinge leaf and engage the second hinge leaf when in the locked position. In the locked position with the catch engaged, the first hinge leaf is prevented from being lifted along the hinge pin to a position of disengagement.

Also disclosed is a method of operating a folding stock equipped with a hinge joint. In one example embodiment, the method includes providing a folding stock with a hinge joint that includes a locking mechanism. From the deployed position of the stock, the user depresses an actuator to unlock the locking mechanism. After unlocking the locking mechanism, the user may disengage the hinge leaves, such as by lifting a first part of the hinge joint relative to a second part of the hinge joint. With the locking mechanism unlocked and the hinge leaves disengaged, the stock can be rotated about the hinge pin to a folded position. From the folded position, the method optionally includes unlocking the locking mechanism and/or disengaging the hinge leaves prior to folding the stock to the deployed position. Numerous variations and embodiments will be apparent in light of the present disclosure.

General Overview

A variety of firearms are equipped with adjustable stocks, including stocks that can be folded against the side of the rifle. In long-range shooting, for example, the overall length of the rifle can easily exceed 48 inches. A folding stock is helpful to reduce the overall length of the rifle during transport and storage. A tactical rifle with a barrel length of about 16-20 inches can similarly benefit from a folding stock to reduce the rifle's overall length. For example, troops who carry rifles in vehicles or aircraft can more easily maneuver in and out of the vehicle with the stock folded, especially when carrying a backpack and other gear.

Current folding stocks have a hinge joint with a single lock structure. For example, the joint is generally constructed as a butt hinge with one leaf of the hinge connected to the buttstock and the second leaf of the hinge mounted to the rear end of the rifle receiver. For example, the bottom edge of the first hinge leaf seats into a recess on the second hinge leaf when the hinge is closed, such as when the stock is deployed. With the edge of the hinge leaf seated in the recess, the stock is blocked from rotating about the hinge pin. To fold the stock against the side of the rifle, the user first lifts up on the stock so that the first hinge leaf slides upward along the hinge pin and out of the recess. In doing so, the bottom edge of the first hinge leaf is elevated above the recess to a clearance position where the stock can be folded to the side of the receiver.

The interlocking structure on existing hinge joints maintains engagement due to spring force and/or gravity. For example, the first hinge leaf can be biased downward by a spring acting on the hinge knuckle. Despite forces biasing the hinge leaves to an engaged position, heavy recoil or impact from the rifle hitting the ground, for example, can be sufficient in some cases to overcome the spring force and disengage the hinge leaves, allowing the stock to fold. Unintended folding of the stock can vary in consequence from an inconvenience to an equipment malfunction that places the operator in great danger. Accordingly, a need exists for improvements to folding stocks to remedy this deficiency. The present disclosure addresses this need and others by providing a hinge joint suitable for use in a folding rifle stock assembly. In accordance with some embodiments, the hinge joint includes a locking mechanism that requires user action to move the mechanism to an unlocked state prior to operating the hinge. The locking mechanism can be used alone or in combination with engagement structures on the hinge joint.

Hinge joints and folding stock assemblies as variously disclosed herein can be used with any suitable host firearm, such as rifles configured for competitive shooting, hunting, or combat, for example. Embodiments of the hinge joint can be used with a variety of firearm stocks, including stocks for bolt-action rifles, tactical or squad rifles, pistol-caliber carbines, long-range target rifles, and combat rifles, to name a few examples. In addition to their utility on folding rifle stocks, hinge joints in accordance with the present disclosure can also be used with other equipment utilizing a hinge joint, as will be appreciated. Numerous other configurations and embodiments will be apparent in light of this disclosure.

As discussed herein, terms referencing direction, such as upward, downward, vertical, horizontal, left, right, front, back, etc., are used for convenience to describe embodiments of a firearm stock positioned in a conventional orientation with the stock seated against the operator's shoulder and the firearm's barrel extending horizontally. Embodiments of the present disclosure are not limited by these directional references and it is contemplated that a stock assembly and hinge joint in accordance with the present disclosure could be used in any orientation.

Note that while generally referred to herein as a hinge joint for consistency and ease of understanding the present disclosure, the disclosed hinge joint is not limited to that specific terminology and alternately can be referred to, for example, as a hinge or other terminology. Also, while generally referred to herein as a stock for consistency and ease of understanding the present disclosure, the disclosed stock is not limited to that specific terminology and alternately can be referred to as a rifle stock, a butt stock, or other terms. Further, while generally referred to herein as a protrusion for consistency and ease of understanding the present disclosure, the disclosed protrusions are not limited to that specific terminology and alternately can be referred to as a catch, an obstruction, a stop, or other terms. As will be further appreciated, the particular configuration (e.g., materials, dimensions, etc.) of a hinge joint, a stock, or rifle stock subassemblies as variously described herein may vary, for example, depending on whether the intended use is military, tactical, or civilian in nature. Numerous configurations and embodiments will be apparent in light of this disclosure.

Example Embodiments

FIG. 1 illustrates a perspective view showing the left, rear, and top sides of a rifle stock assembly 100 in accordance with an embodiment of the present disclosure. The rifle stock assembly includes a butt plate 102 telescopically or slidably mounted on a longitudinal support 104 and a hinge joint 110 secured to a distal end 104*a* of the longitudinal support 104. Although the stock assembly 100 is shown as having an adjustable length, this is not required, and other fixed or adjustable stocks can be used, as will be appreciated. The hinge joint 110 includes a first hinge leaf 112 and a second hinge leaf 114 that can pivot about a hinge pin 120 with respect to each other. As shown in this example, the first hinge leaf 112 is secured to the distal end 104*a* of the support 104. The second hinge leaf 114 is secured to the proximal end of a rifle receiver 90. In this example, the second hinge leaf 114 includes a clamp structured to engage a mounting rail or the like (e.g., a MIL-STD-1913 or Picatinny rail) on the firearm receiver 90. In other embodiments, the second hinge leaf 114 can be secured to the receiver 90 using fasteners or other suitable means.

Figure 2:
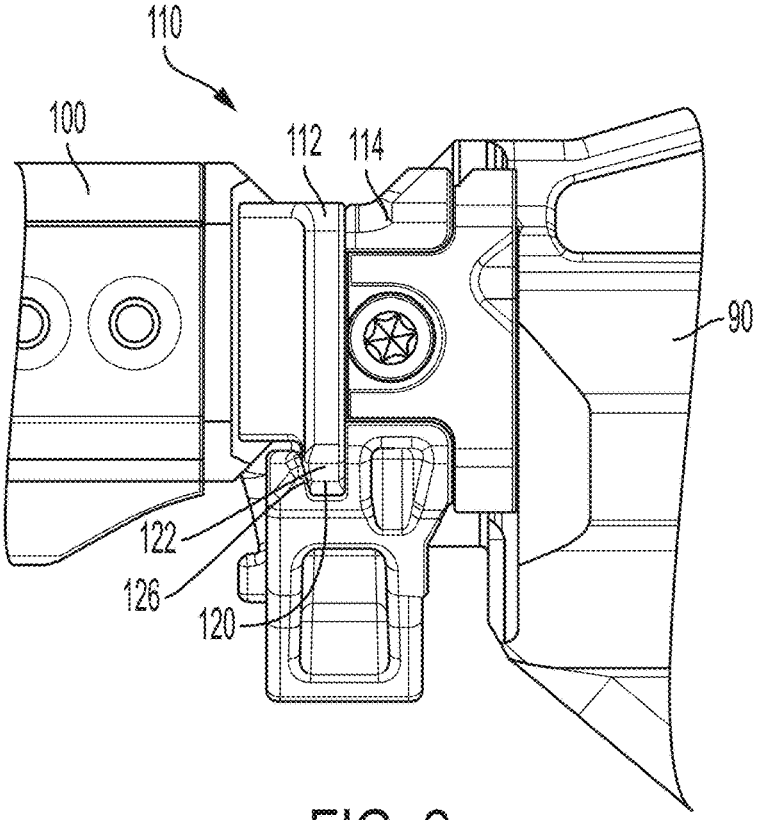
FIG. 2 is an elevational view showing the right side of a hinge joint connected between a rifle receiver and a rifle stock, where the hinge joint is in a locked position with part of the first hinge leaf received in a slot of the second hinge leaf, in accordance with an embodiment of the present disclosure.
Figure 3:
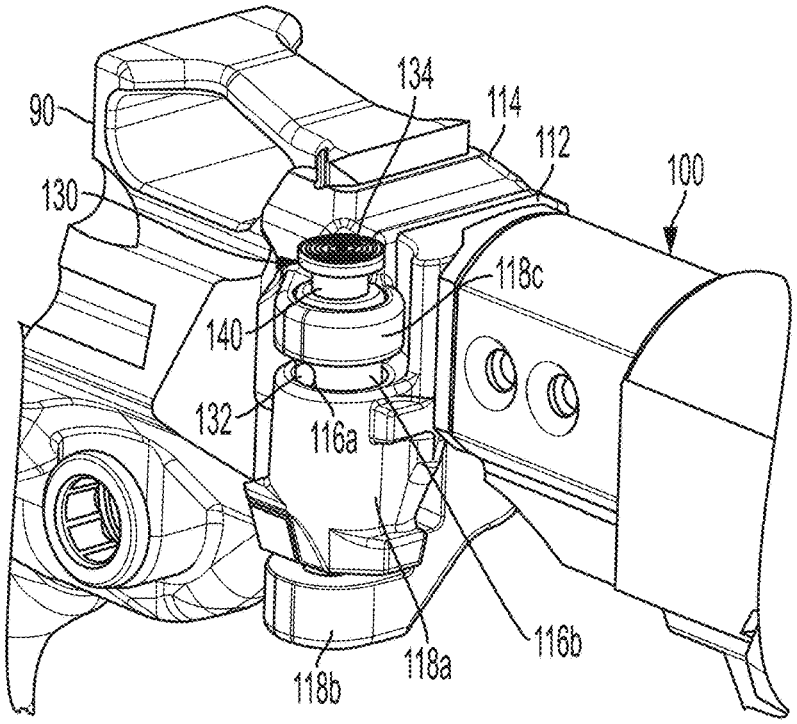
FIG. 3 is a perspective view showing the top, left, and rear sides of a hinge joint and rifle stock assembly with a locking mechanism in a locked position, in accordance with an embodiment of the present disclosure.
Figure 4:
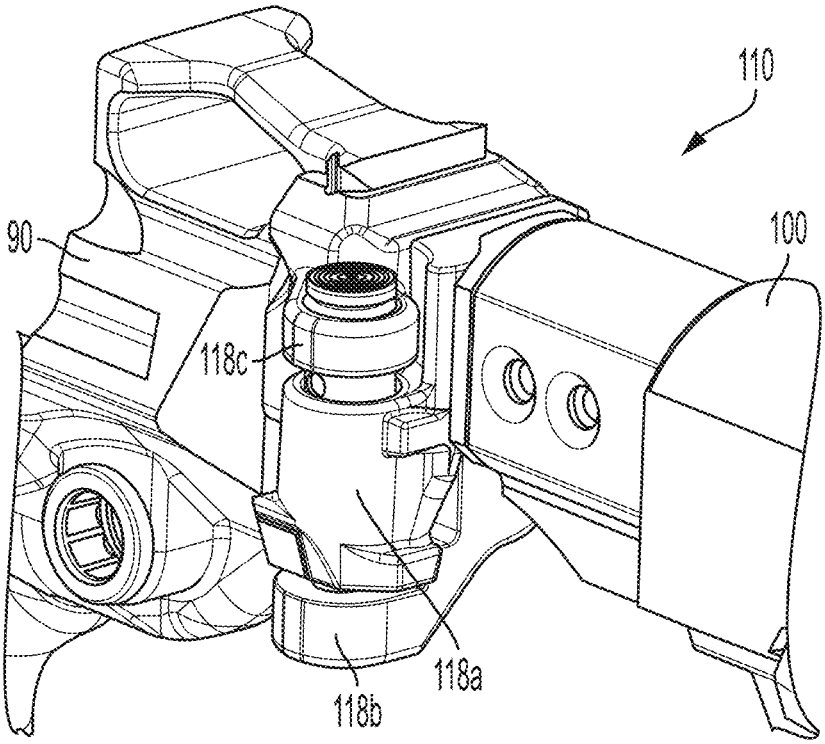
FIG. 4 is a perspective view of the hinge joint of FIG. 3 showing the locking mechanism in an unlocked position, in accordance with an embodiment of the present disclosure.
Figure 5:
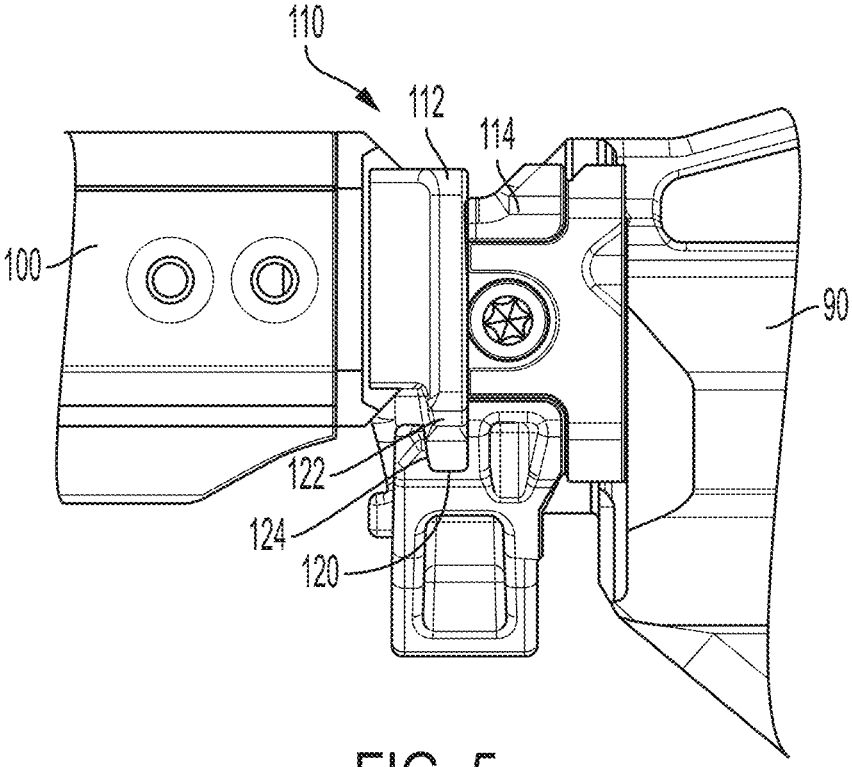
FIG. 5 is an elevational view showing the right side of a hinge joint connected between a rifle receiver and a stock, where the hinge joint is in an unlocked position with the first hinge leaf raised to a clearance position with respect to the second hinge leaf, in accordance with an embodiment of the present disclosure.

FIGS. 2-5 illustrate the hinge joint 110 assembled to a rifle stock assembly 100 (or simply "stock") and a firearm receiver 90, where the rifle stock assembly 100 is folded to a deployed position, in accordance with an embodiment of the present disclosure. FIGS. 2 and 5 show the right side of the hinge joint 110 and FIGS. 3 and 4 show the top, left, and rear sides of the hinge joint 110. In FIGS. 2-3, the portions of the hinge leaves 112, 114 engage one another and the locking mechanism 130 is in the locked position. In FIGS. 4 and 5 the locking mechanism 130 is in the unlocked position. In FIG. 5, the first hinge leaf 112 is in a raised position and disengaged from the second hinge leaf 114. FIGS. 2-5 will be discussed concurrently below.

As noted above, the hinge joint 110 includes a first hinge leaf 112 and second hinge leaf 114 that can pivot about a hinge pin 116 extending through one or more knuckles connected to the hinge leaves 114, 116. For example, the first hinge leaf 112 has a first hinge knuckle 118*a* positioned between second and third hinge knuckles 118*b*, 118*c* attached to the second hinge leaf 114. The first hinge knuckle 118*a* on the first hinge leaf 112 has a vertical size that is less than the gap between the second and third knuckles 118*b*, 118*c* on the second hinge leaf 114 so as to permit the first hinge leaf 112 to translate axially (e.g., vertically) along the hinge pin 116.

As shown in FIGS. 2 and 5, the second hinge leaf 114 defines a slot 120 along its lower portion. The slot 120 is offset from the face of the hinge leaf 114 and positioned to receive the bottom edge portion 122 of the first hinge leaf 112 when the stock 100 is deployed and the first hinge leaf 112 abuts the second hinge leaf 114. In one embodiment, the slot 120 has a sloped face 124 that defines a wedge shape. When the first and second hinge leaves 112, 114 abut each other, and the bottom edge portion 122 is urged downward against the sloped face 124 by gravity and/or spring pressure, the first hinge leaf 112 is drawn tightly against the second hinge leaf 114 for a rigid joint that is free or substantially free of excess movement. In some embodiments, the bottom edge portion 122 of the first hinge leaf defines a corresponding sloped surface 126 that mates with and engages the sloped face 124 of the slot 120.

In FIGS. 2-4, the first hinge leaf 112 is in a lowered position with the bottom edge portion 122 received in the slot 120 of the second hinge leaf 114. This position can be referred to as the locked position or engaged position for this interlocking feature. To fold the stock, the first hinge leaf 112 must first be disengaged from the second hinge leaf 114 by shifting the first hinge leaf 112 upward along the hinge pin 116 until the bottom edge portion 122 is removed from and clear of the slot 120. In this embodiment, however, an additional or second locking mechanism 130 includes one or more protrusions 132 biased into a blocking position that prevents axial movement of the first hinge leaf 112 along the hinge pin 116. In this example, the locking mechanism 130 includes one or more spring-biased protrusions 132 (e.g., balls) that are partially housed in the hinge pin 116. Each protrusion 132 protrudes from an opening 116*a* in the upper portion 116*b* of the hinge pin 116 when the locking mechanism 130 is in the locked condition.

Figure 6A:
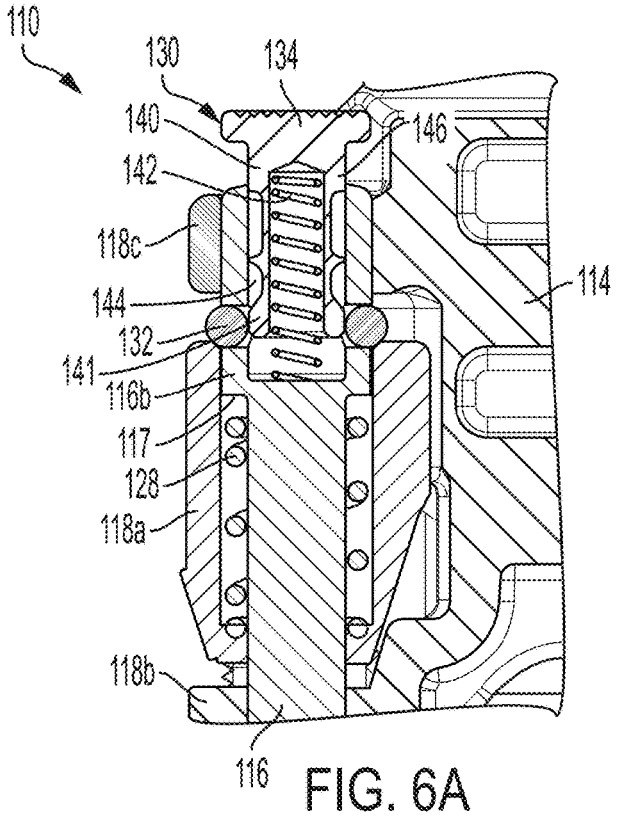
FIG. 6A illustrates a cross-sectional view of a hinge joint taken through the hinge pin and locking mechanism, where the locking mechanism is in a locked position, in accordance with an embodiment of the present disclosure.

In the locked position, such as shown in FIGS. 3 and 6A, the protrusion 132 extends radially outward from the hinge pin 116 into the path of the first hinge knuckle 118*a*, blocking axial movement of the first hinge leaf 112 along the hinge pin 116. In this example, the protrusion 132 engages a top end of the first hinge knuckle 118*a*. In the locked condition, the first hinge leaf 112 is blocked from being raised to disengage the bottom edge portion 122 from the slot 120 and permit folding open the hinge joint 110. To unlock the locking mechanism 130, the user can depress an actuator 134 at the top of the hinge pin 116.

In some embodiments, the actuator 134 is a push button or lever. For example, the button is on top of a pin that can be actuated against spring pressure. In another example, the actuator 134 is a cam action lever where either depressing or rotating the lever moves a connected pin along its axis. When the actuator 134 is a lever extending perpendicular from a pin, for example, the lever can be retained in a V-shaped groove such that rotating the lever causes the attached pin to be cammed upward by engagement between the lever and the sloped walls of the V-shaped groove. Numerous embodiments and variations will be apparent in light of the present disclosure.

As illustrated in FIGS. 3 and 6A, for example, the actuator 134 is raised when the locking mechanism 130 is in the locked condition. As will be discussed in more detail below, when the locking mechanism 130 is in the locked condition, the protrusions 132 are displaced by the plunger 140 to protrude from the hinge pin 116; depressing the actuator 134 aligns or opens a recess in the plunger 140 that allows the protrusion 132 to retract into the hinge pin 116 and out of the path of the first hinge knuckle 118*a*. In one embodiment, the actuator 134 is conveniently positioned over the hinge pin 116 so that the user may depress the actuator 134 with the thumb while subsequently or simultaneously wrapping the fingers around the stock support 104 and pulling upward to disengage the first hinge leaf 112 from the second hinge leaf 114.

Figure 6B:
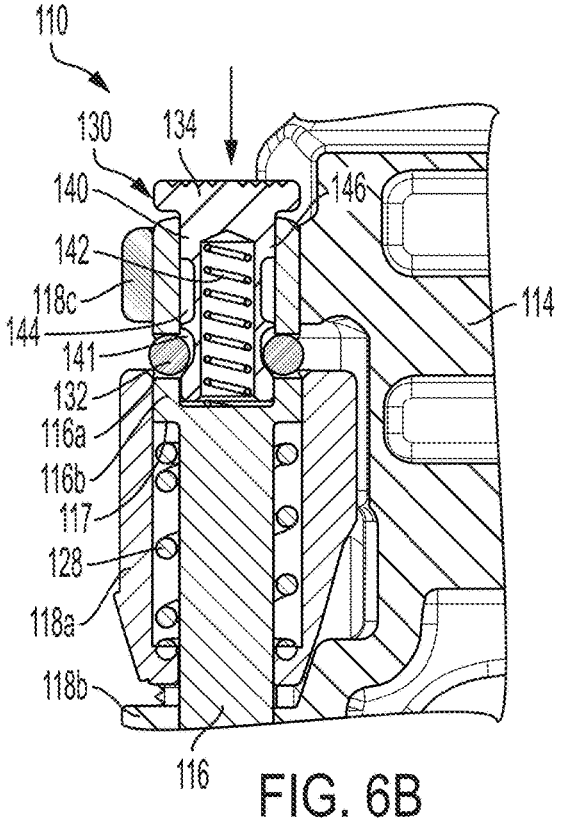
FIG. 6B shows the cross-sectional view of the hinge joint of FIG. 6A with the locking mechanism in an unlocked position and the first hinge knuckle in a lowered position, in accordance with an embodiment of the present disclosure.

As shown in FIGS. 4 and 6B, for example, the actuator 134 is depressed, placing the locking mechanism 130 is in the unlocked condition. When the actuator 134 is depressed, the protrusion(s) 132 can move into the hinge pin 116 and out of the path of the first hinge knuckle 118*a*. Accordingly, the protrusion(s) 132 do not obstruct the first hinge knuckle 118*a* from sliding upwardly along the hinge pin 116 to a position where the first hinge leaf 112 disengages from the second hinge leaf 114. Note that in some embodiments the protrusion(s) can be floating in that each protrusion need not be attached to any particular component. For example, each protrusion is captured between components and its position is determined by the relative alignment of openings.

Figure 4A:
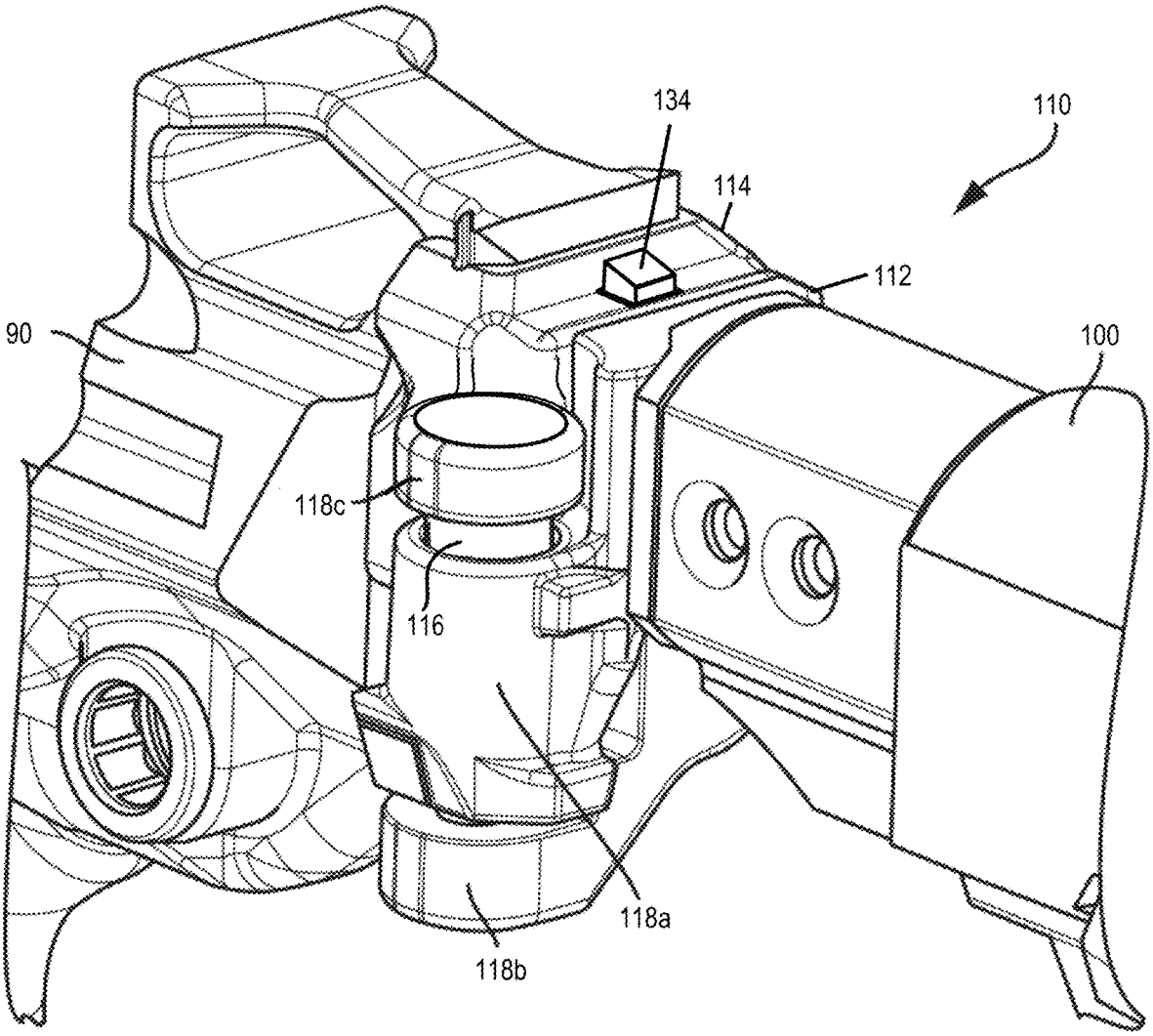
FIG. 4A is a perspective view of a hinge joint having the actuator of the locking mechanism on the second hinge leaf, in accordance with another embodiment of the present disclosure.

FIG. 4A shows an embodiment that is similar to that shown in FIG. 4. In this example, the actuator 134 is on top of the second hinge leaf 114 rather than on the hinge pin 116. Depressing the actuator 134 toggles a latch (not visible) between the first hinge leaf 112 and second hinge leaf 114. When the actuator 134 is depressed, the latch moves to a non-blocking position (e.g., flush with the face of the second hinge leaf 114) that allows the first hinge leaf 112 to be lifted along the hinge pin 116, such as to disengage the first hinge leaf 112 from the second hinge leaf 114.

In FIG. 5, a view of the right side of the hinge joint 110 shows the stock 100 and first hinge leaf 112 in a raised position in which the bottom edge portion 122 of the first hinge leaf 112 is disengaged from and clears the slot 120 in the second hinge leaf 114. In this raised position, the first hinge leaf 112 is clear to rotate about the hinge pin 116. Thus, for example, the user first unlocks the locking mechanism 130 on the hinge pin 140, then lifts up on the stock 100 to lift the first hinge leaf 112 out of the slot 120 defined in the second hinge leaf 114, followed by rotation of the stock 100 to the folded position. A method 300 of operating a folding stock is discussed in more detail below.

Figure 6C:
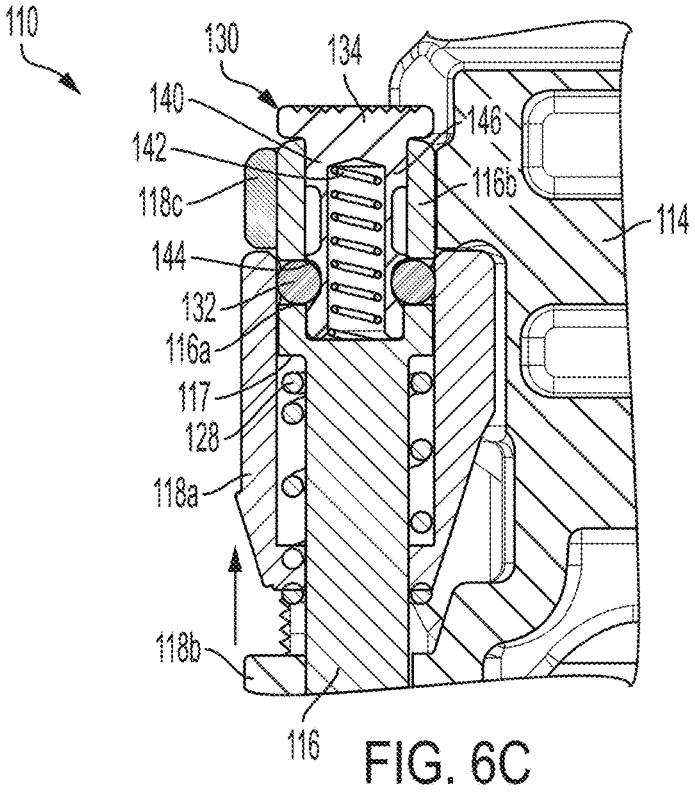
FIG. 6C shows the cross-sectional view of the hinge joint of FIG. 6A with the locking mechanism in an unlocked position and the first hinge knuckle in a raised position, in accordance with an embodiment of the present disclosure.

Referring now to FIGS. 6A-6C, cross-sectional views taken through the hinge pin 116 show the hinge joint 110 and locking mechanism 130 in more detail, in accordance with an embodiment of the present disclosure. As with embodiments discussed above, the hinge joint 110 includes first hinge leaf 112 (not visible) and second hinge leaf 114. The first hinge leaf 112 is connected to a first hinge knuckle 118*a* located vertically between second and third hinge knuckles 118*b*, 118*c* connected to the second hinge leaf 114. A coil spring 128 on the lower portion of the hinge pin 116 is positioned within the first hinge knuckle 118*a* and biases the first hinge leaf 112 downward by urging against the shoulder 117 of the upper portion 116*b* of the hinge pin 116, which has a greater diameter in this example. An upper portion 116*b* of the hinge pin 116 is hollow and receives components of the locking mechanism 130.

The locking mechanism 130 includes a plunger 140 received in the hollow or void of the upper portion 116*b* of the hinge pin 116. The plunger 140 includes the actuator 134 at its top end, such as a push surface. The plunger 140 is biased to a raised position by a spring 142 acting on the plunger 140. For example, the spring 142 is compressed between the hinge pin 116 and the actuator 134 or another portion of the plunger 140. The plunger 140 defines one or more recesses 144 extending radially into the plunger body 146. Each recess 144 is configured to receive part of the protrusion 132 (e.g., ball). In the locked condition with the actuator 134 in the raised position, such as shown in FIG. 6A, the recess 144 is positioned vertically along the plunger 140 to be misaligned with the protrusions 132 and openings 116*a* in the hinge pin 116. In this example, the recess 144 is above the protrusions 132. Due to spring bias, the bottom portion 141 of the plunger 140, which has a diameter substantially complimentary to that of the hollow in the hinge pin 116, aligns with the protrusions 132 when the locking mechanism 130 is locked. In such a position, the plunger 140 displaces the protrusions 132 to a radial outward position in which each protrusion 132 protrudes beyond the wall of the hinge pin 116. In this position, each protrusion 132 is positioned closely adjacent or in contact with the top of the first hinge knuckle 118*a* and obstructs vertical movement of the first hinge knuckle 118*a* along the hinge pin 116, such as shown in FIG. 6A.

FIG. 6B shows the locking mechanism 130 after the actuator 134 has been depressed. In the depressed position, the recess 144 in the plunger 140 can be aligned with the protrusions 132 and allow the protrusions to recess radially into the hinge pin 116. The recess 144 has a radial depth sufficient to receive part of each protrusion 132 so that it does not extend radially outward into the path of the first hinge knuckle 118*a*. In this non-blocking position, the protrusions 132 do not obstruct vertical movement of the first hinge knuckle 118*a*. Note that even if the protrusions 132 do not freely move into the recess 144 by gravity, moving the first hinge knuckle 118*a* along the hinge pin 116 will displace the protrusions 132 radially inward so long as the recess 144 is sufficiently aligned with the opening 116*a* in the hinge pin 116.

FIG. 6C shows the locking mechanism 130 in an unlocked condition the first hinge knuckle 118*a* has been moved upward along the hinge pin 116. In this position, each protrusion 132 is retained by the first hinge knuckle 118*a* within opening 116*a* in the hinge pin 116 and the recess 144 of the plunger 140. Accordingly, the plunger 140 and actuator 134 are maintained in a depressed or locked position. In this position, the top of the first hinge knuckle 118*a* is closely adjacent the upper or third hinge knuckle 118*c* above it and the bottom of the first hinge knuckle 118*a* is spaced above the top of the lower or second hinge knuckle 118*b*. In this example embodiment, the locking mechanism 130 optionally remains in the unlocked position while the hinge joint 110 is folded to the open hinge position. In other embodiments, the first hinge leaf 112 can be lowered along the hinge pin 116 when the hinge joint 110 is in the open hinge position. In some such embodiments, the user may again need to depress the actuator 134 to unlock the locking mechanism 130 prior to moving the hinge joint 110 to the closed hinge position.

Figure 7:
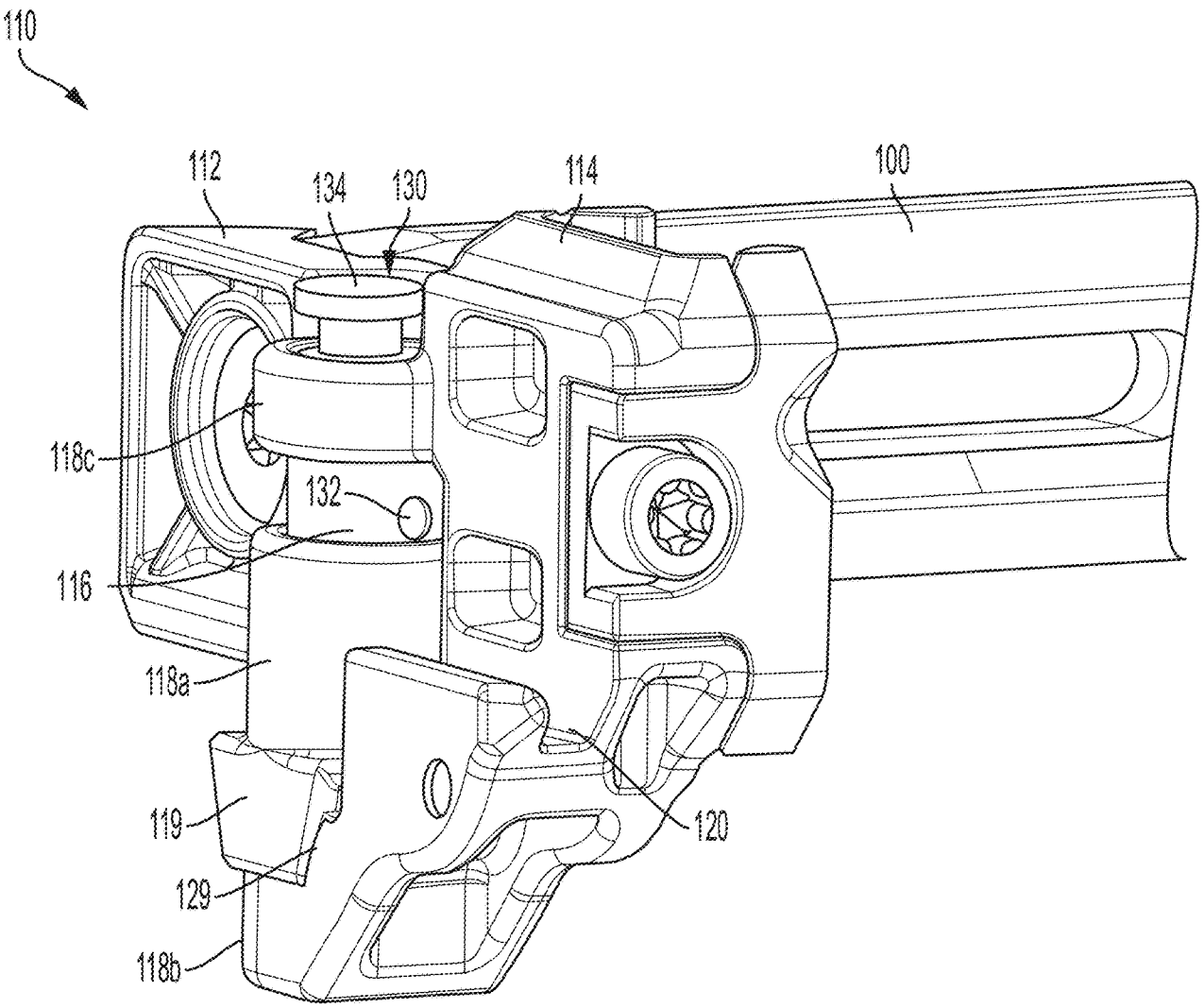
FIG. 7 is a perspective view showing the rear and right sides of a hinge joint in an open hinge position with the locking mechanism in a locked condition, in accordance with an embodiment of the present disclosure.

Referring now to FIG. 7, a perspective view shows the right and rear sides of the rifle stock assembly 100 with the stock 100 in a folded position, the hinge joint 110 in an open hinge position, and the locking mechanism 130 in the locked condition, in accordance with an embodiment of the present disclosure. In this embodiment, the bottom portion 119 of the first hinge knuckle 118*a* has a wedge shape that mates with a corresponding sloped surface 129 on the second hinge knuckle 118*b*. For example, upon reaching the open hinge position, the first hinge knuckle 118*a* can resume a lowered position with the bottom portion 119 seated against the corresponding sloped surface 129 of the second hinge knuckle 118*b*. The mating surfaces provide a stable position that resists rotation of the hinge joint 110 until the first hinge leaf 112 is raised. When the first hinge knuckle 118*a* returns to the lowered position, the protrusion(s) 132 are unobstructed by the first hinge knuckle 118*a*. Due to the spring bias, the plunger 140 moves upward and the plunger 140 displaces the protrusions 132 to protrude from the hinge pin 116 in a blocking position.

In other embodiments, the bottom portion 119 of the first hinge knuckle 118*a* is shaped to prevent lowering the first hinge knuckle 118*a*, thereby maintaining the locking mechanism 130 in an unlocked condition. For example, the first hinge knuckle 118*a* overlaps the protrusions 132 and retains the protrusions 132 in the hinge pin 116 and the locking mechanism 130 in the unlocked condition. In one such embodiment, the bottom portion 119 of the first hinge knuckle 118*a* abuts the top surface of the second hinge knuckle 118*b*, a shelf on the hinge joint 110, or functionally equivalent structure that prevents the first hinge knuckle 118*a* from lowering. For example, the bottom portion 119 of the first hinge knuckle 118*a* has an asymmetrical shape or a greater vertical size on one portion such that the first hinge knuckle 118*a* remains in a raised position (and therefore an unlocked condition for locking mechanism 130) when the hinge is in the open hinge position.

Figure 8:
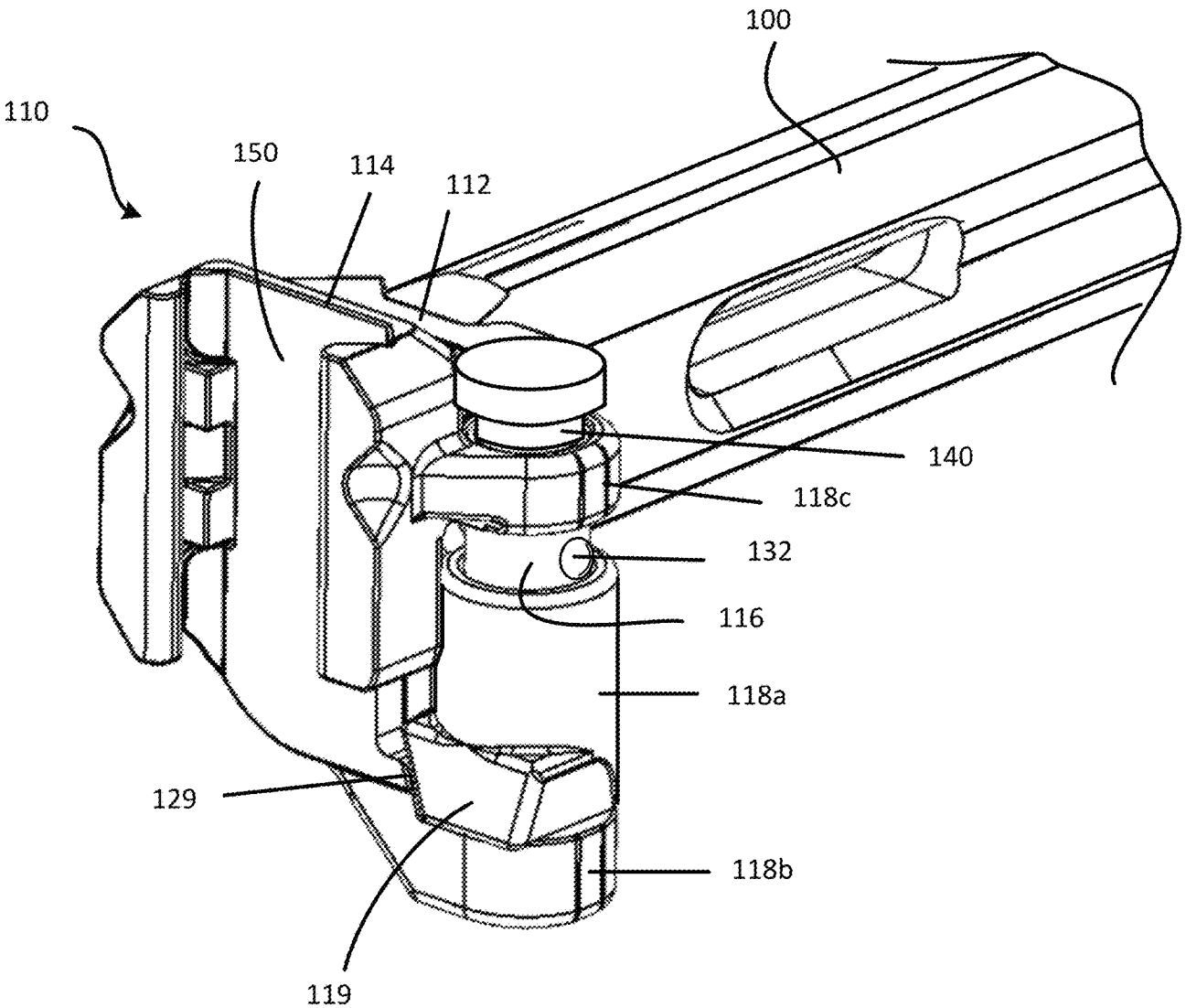
FIG. 8 is a perspective view showing the top, front, and left sides of a hinge joint in a closed hinge position and the locking mechanism in a locked condition, in accordance with an embodiment of the present disclosure.

FIG. 8 illustrates a perspective view showing the top, front, and left sides of the hinge joint 110 and a portion of the stock 100 of FIG. 7. In this example, the stock 100 has been moved to the deployed position with the hinge joint 110 in a closed hinge position. The locking mechanism 130 is in the locked condition with the protrusion 132 extending out from the hinge pin 116. The plunger 140 is in the raised position and the first hinge knuckle 118*a* is in a lowered position atop the second hinge knuckle 118*b*. In this lowered position, the wedge-shaped bottom portion 119 of the first hinge knuckle 118*a* engages the corresponding sloped surface 129 of the second hinge knuckle 118*b*. In combination with engagement between the sloped surface 124 of the slot 120 (not visible), the hinge joint 110 has a binding condition that reduces or eliminates free movement in the hinge joint 110. Also shown in FIG. 8 is the distal face 150 of the second hinge leaf 114, which is configured to abut or face the rifle receiver 90 when installed on a firearm. In this example, the second hinge leaf 114 is configured as a clamp to engage a mounting rail on the rifle receiver 90 (shown in FIG. 1).

Figure 9:
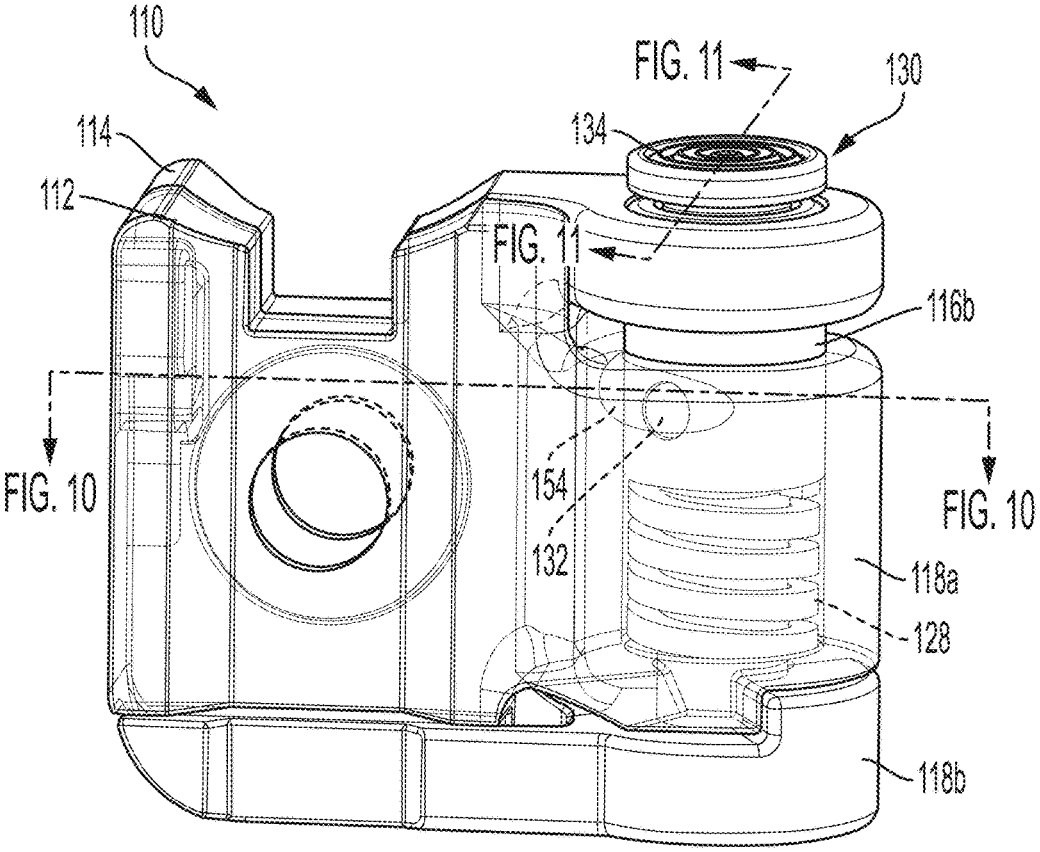
FIG. 9 illustrates a hinge joint in a closed hinge position with a locking mechanism in an unlocked position, in accordance with an embodiment of the present disclosure.
Figure 10:
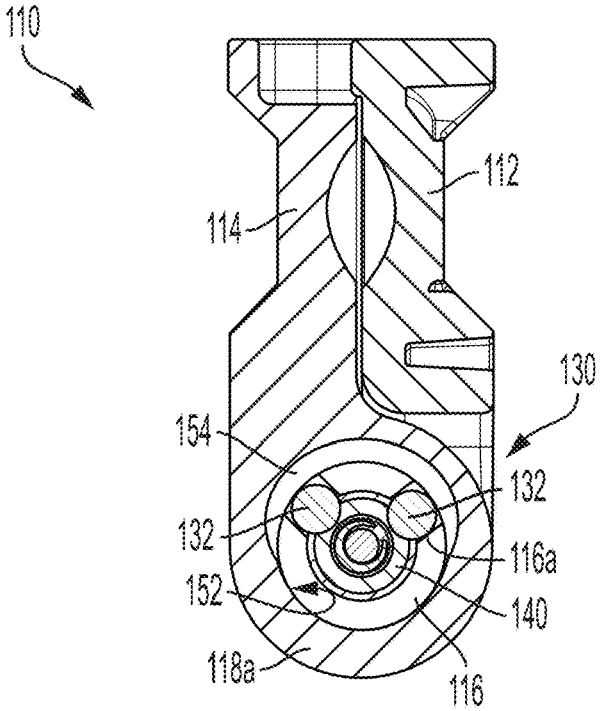
FIG. 10 is a top, cross-sectional view as taken along the section line shown in FIG. 9 and shows portions of the hinge joint and locking mechanism of FIG. 9, in accordance with an embodiment of the present disclosure.
Figure 11A:
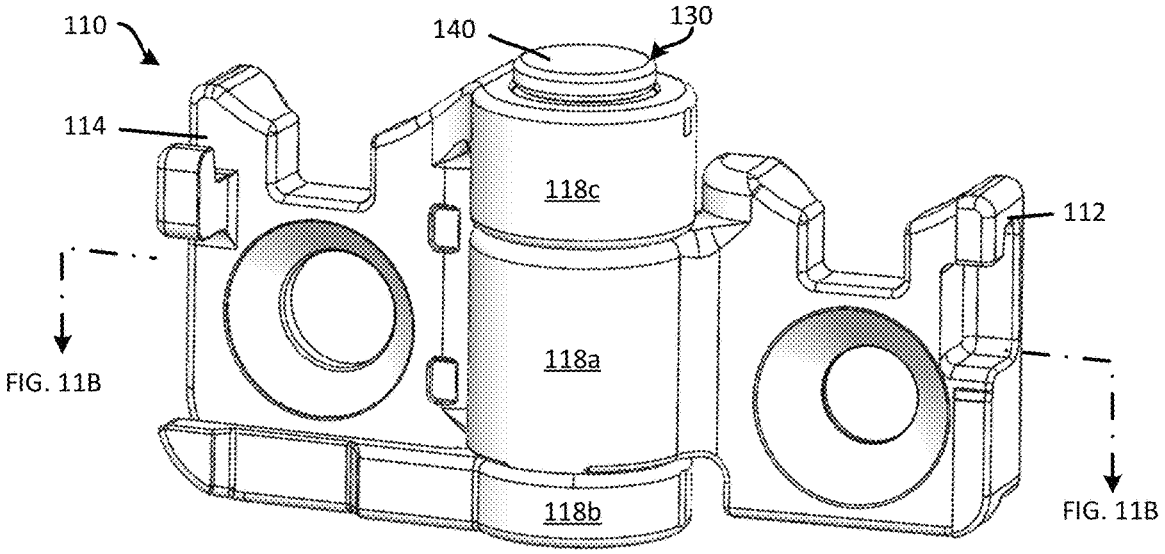
FIG. 11A is a perspective view of a hinge joint in an open hinge position and with the locking mechanism in an unlocked condition, in accordance with an embodiment of the present disclosure.
Figure 11B:
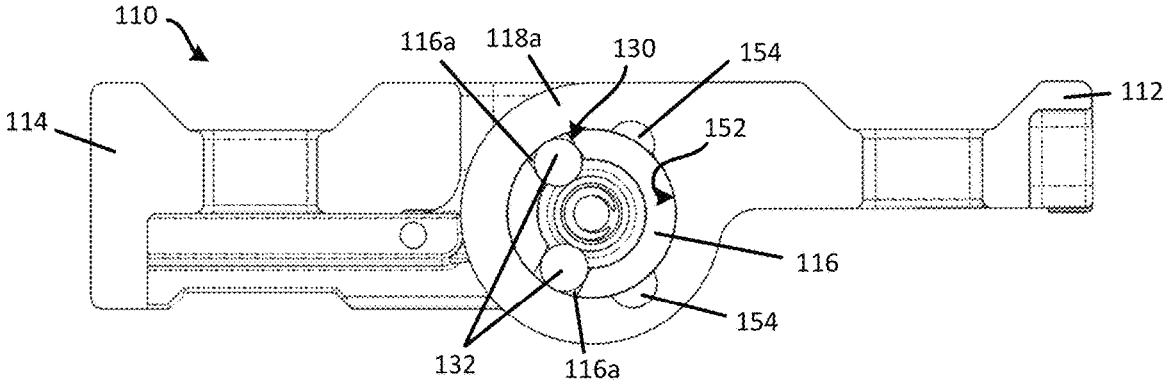
FIG. 11B is a top, cross-sectional view of the hinge joint of FIG. 11A as taken along the section line shown in FIG. 11A, in accordance with an embodiment of the present disclosure.
Figure 11C:
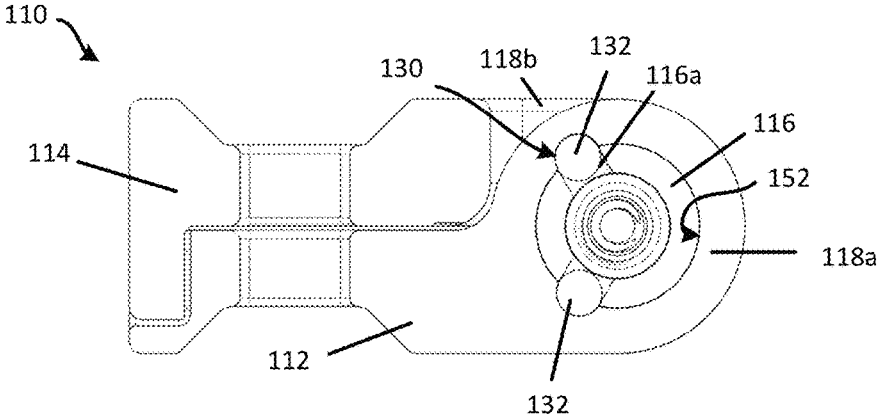
FIG. 11C is a top, cross-sectional view of the hinge joint of FIG. 11B shown in a closed hinge position and locked condition, in accordance with an embodiment of the present disclosure.
Figure 12:
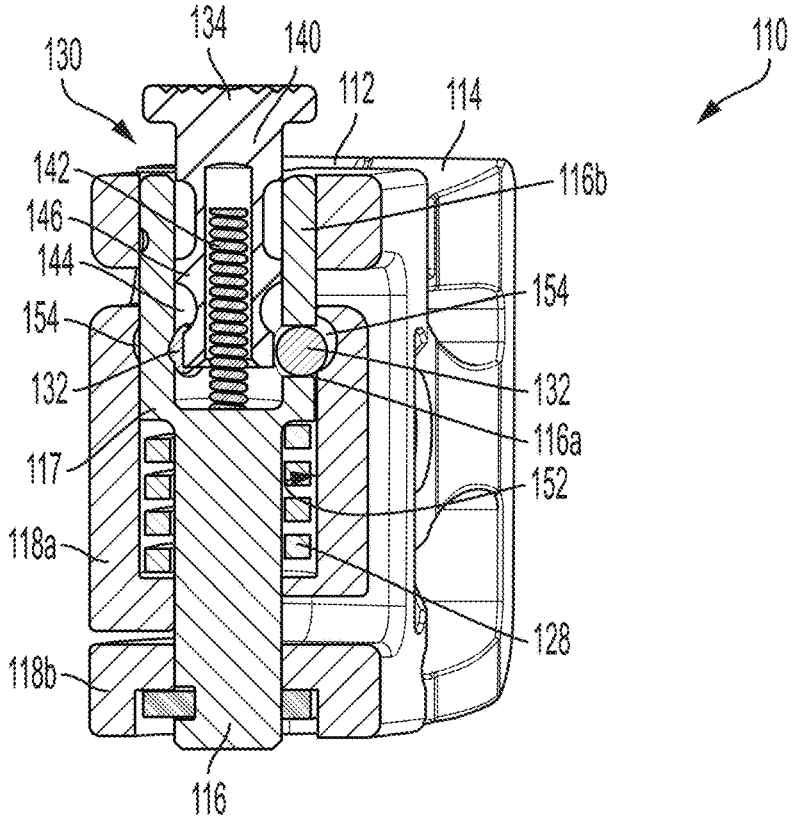
FIG. 12 is a cross-sectional view of the hinge joint as taken along the section line shown in FIG. 9, shows the first hinge leaf in a lowered position, and shows the locking mechanism in a locked position, in accordance with an embodiment of the present disclosure.
Figure 13:
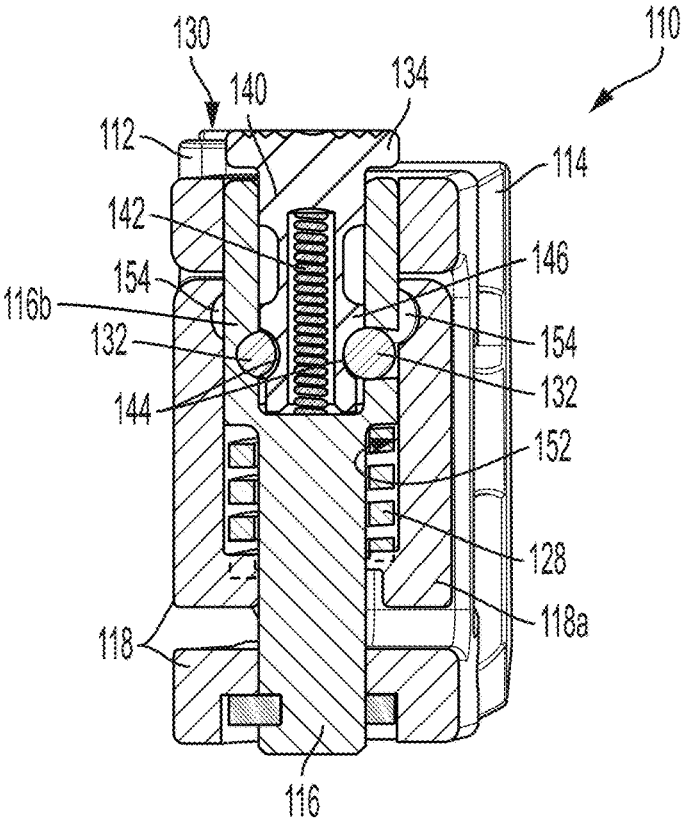
FIG. 13 is a cross-sectional view of the hinge joint of FIG. 12, showing the first hinge leaf in a raised position and the locking mechanism in an unlocked position, in accordance with an embodiment of the present disclosure.
Figure 14:
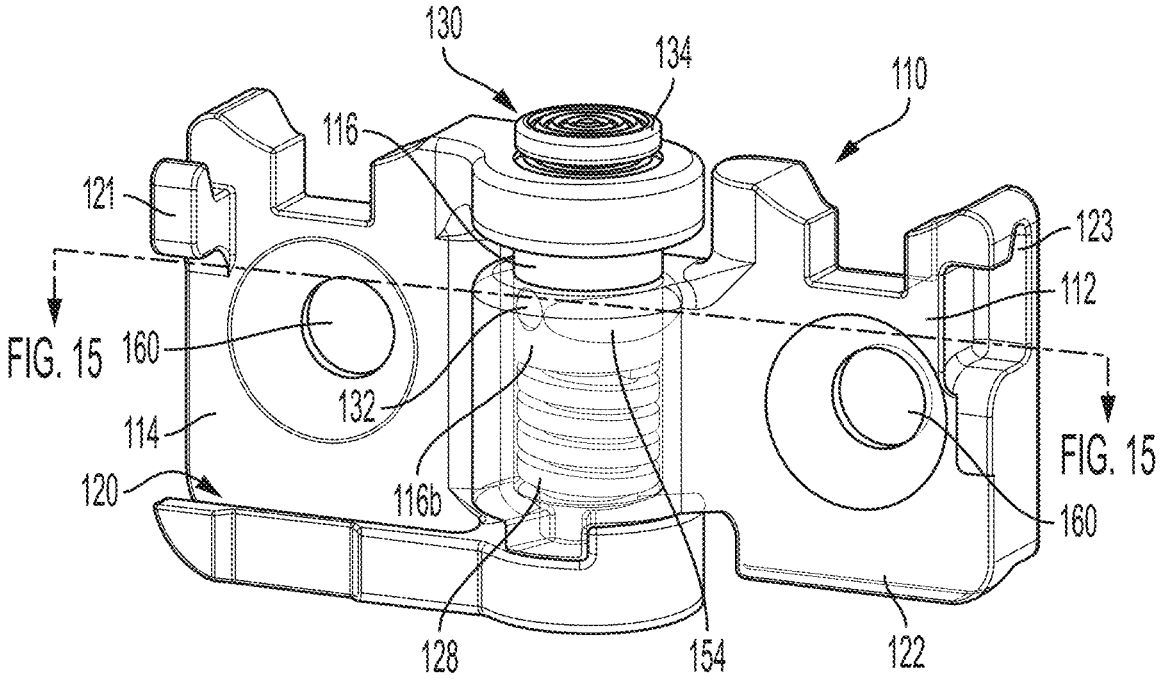
FIG. 14 illustrates a perspective view of a hinge joint in an open hinge position with the locking mechanism in an unlocked position, in accordance with an embodiment of the present disclosure.
Figure 15:
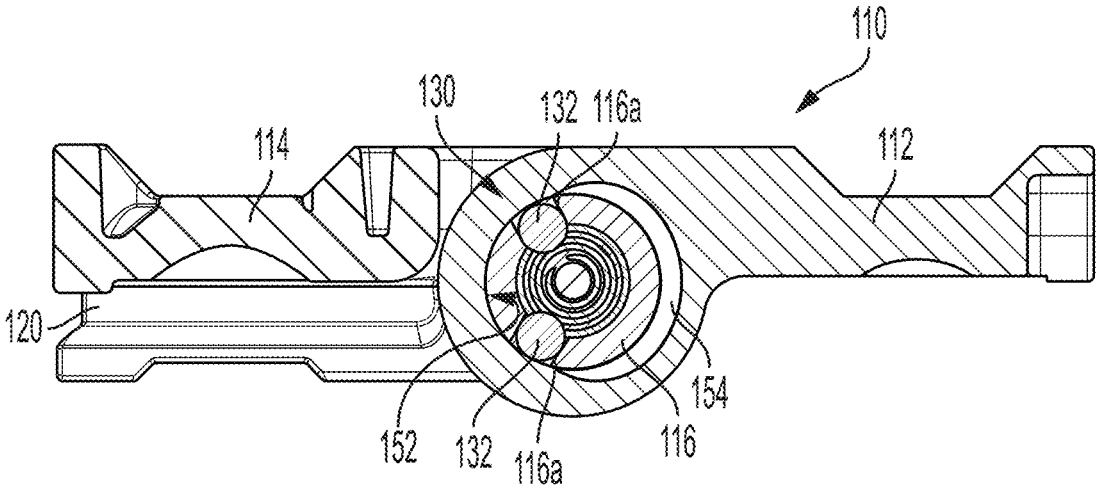
FIG. 15 illustrates a top cross-sectional view of the hinge joint as taken the section line of FIG. 14 and showing the locking mechanism in an unlocked position, in accordance with an embodiment of the present disclosure.

Referring now to FIGS. 9-15, a hinge joint 110 is shown with a locking mechanism 130 that includes protrusions 132 along an inner wall 152 of the hinge knuckle 118, in accordance with some embodiments of the present disclosure. FIG. 9 is a perspective view showing the hinge joint 110 in a closed hinge position with the first hinge leaf 112 abutting the second hinge leaf 114. FIG. 10 is a cross-sectional view of the hinge joint 110 of FIG. 9 as taken along the section line indicated in FIG. 9. FIGS. 11A-11C illustrate a hinge joint 110 in an open hinge position, a top cross-sectional view of the open hinge position, and a top cross-sectional view of the hinge joint 110 in a closed hinge position. FIGS. 12 and 13 are cross-sectional views of a hinge joint 110 showing the hinge joint 110 in a closed hinge position and locking mechanism 130 in a locked position and an unlocked position, respectively. FIG. 14 is a perspective view showing the hinge joint 110 of FIG. 9 in an open position with the first hinge leaf 112 rotated about 180° with respect to the second hinge leaf 114, and FIG. 15 is a cross sectional view of the hinge joint 110 of FIG. 9 in an open hinge position as taken along the section line as indicated in FIG. 14. In FIG. 9, the first hinge leaf 112 is illustrated as being transparent to better show the hinge pin 116 and related components. Note that the actual appearance of the first hinge leaf 112 (and/or other components) may differ and does not affect the function of the hinge joint 110, as will be appreciated. FIGS. 9-15 will be discussed concurrently below.

As with embodiments discussed above, the hinge joint 110 has first hinge leaf 112 and second hinge leaf 114 that pivot about a hinge pin 116 between a closed hinge position (e.g., FIG. 9) and an open hinge position (e.g., FIG. 13). The hinge knuckles 118 are sized and positioned to allow axial movement of the first hinge leaf 112 along the hinge pin 116 with respect to the second hinge leaf 114, such as the positions shown in FIGS. 11-12. When the hinge joint 110 is in the closed hinge position with the first hinge leaf 112 lowered, the first hinge leaf 112 engages the second hinge leaf 114 with locking interference between structures on the leaves so as to prevent moving the hinge joint 110 out of the closed hinge position. As shown in FIG. 13, for example, the first hinge leaf 112 has a bottom edge portion 122 that can be received in a slot 120 on the second hinge leaf 114. Also, the second hinge leaf 114 defines a catch 121 that is received in a corresponding catch recess 123 on the first hinge leaf 112 when the first hinge leaf 112 is in the lowered position. The bottom edge portion 122 and catch 121 are examples of structures that provide engaged and disengaged positions based on the rotation and elevation of the first hinge leaf 112 relative to the second hinge leaf 114.

Also similar to embodiments discussed above, at least an upper portion of the hinge pin 116 is hollow to receive the plunger 140. The plunger 140 defines one or more recesses 144 to accommodate protrusions 132 (e.g., balls) and includes the actuator 134 at its top end. Protrusions 132 are partially housed in openings 116*a* in the upper portion of the hinge pin 116. The protrusions 132 can occupy the recesses 144 in a non-blocking position when the plunger 140 is depressed so that the recesses 144 align with the opening 116*a* in the wall of the hinge pin 116. The upper portion 116*b* of the hinge pin 116 has a shoulder 117 at its bottom end. The first hinge leaf 112 is biased downward by a coil spring 128 between the second hinge knuckle 118*b* and the shoulder 117 on the hinge pin 116. When in the downward position, the first hinge leaf 112 engages or interlocks with the second hinge leaf 114 so as to prevent rotation of the first hinge leaf 112 from the closed position to the open position.

When the plunger 140 is depressed, the protrusions 132 move into the recesses 144. The protrusions 132 are maintained in the recesses 144 by the inner wall 152 of the overlapping first hinge knuckle 118*a* as the first hinge knuckle 118*a* is raised along the hinge pin 116, such as shown in FIG. 12. For example, the inner wall 152 closely abuts the outer surface of the upper portion 116*b* of the hinge pin 116, and when the first hinge knuckle 118 is raised, the inner wall 152 blocks the protrusions 132 from moving out of the recesses 144. While the protrusions 132 occupy the recesses 144, part of each protrusion 132 also occupies opening 116*a* in the hinge pin 116. As such, the plunger 140 is blocked from returning to its up or locked position even though the spring 142 urges the plunger 140 to return upward.

When the plunger 140 is in the up or locking position, the body 146 of the plunger 140 forces the protrusions 132 outward through the opening 116*a* in the hinge pin 116 so that part of each protrusion 132 occupies a recess 154 defined in the inner wall 152 of the first hinge knuckle 118*a*. In such a position, part of the protrusion 132 occupies the recess 154 in the inner wall 152 and part of the protrusion 132 occupies the recess 144 in the plunger 140, thereby blocking vertical movement of the first hinge leaf 112. In the same position, however, the plunger 140 is not blocked by the protrusion(s) 132, therefore allowing the spring 142 and user action to move the plunger 140 between the locked and unlocked positions.

In more detail, FIGS. 9 and 10 show the actuator 134 depressed so that the protrusions 132 can move into the recesses 144 in the plunger 140, rather than the recess 154 in the inner wall 152 of the first hinge knuckle 118*a*. Even though the protrusions 132 are in a non-blocking position, the first hinge leaf 112 is in a lowered position in FIG. 9, but the locking mechanism 130 is unlocked and permits moving the first hinge leaf 112 upward to disengage the first hinge leaf 112 from the second hinge leaf 114.

In the cross-sectional view of FIG. 10, the protrusions 132 occupy the opening 116*a* in the hinge pin 116. The recess 154 along the inside of the first hinge knuckle 118*a* defines a region of greater inner diameter that can accommodate the protrusions 132 when the locking mechanism 130 is in the locked condition. When the protrusions 132 are recessed into the hinge pin 116 in the non-blocking position, the first hinge knuckle 118*a* can pivot and/or translate vertically about the hinge pin 116 without interference between the inner wall 152 of the first hinge knuckle 118*a* and the protrusions 132. In some embodiments, the locking mechanism 130 is a second locking structure that is used in combination with other engagement structures of the joint 110 (e.g., bottom edge portion 122 and slot 120). In other embodiments, the locking mechanism 130 is the sole locking structure for the hinge joint 110, such as when the hinge leaves do not move vertically along the hinge pin 116 with respect one another.

FIGS. 11A-11C show a hinge joint 110 with a locking mechanism 130 that moves between locked and unlocked positions, in accordance with another embodiment of the present disclosure. In this example, the locking mechanism 130 includes a plunger 140 partially housed within the hinge pin 116. When the plunger 140 is depressed, such as shown in FIG. 11A, the locking mechanism 130 is in the unlocked position and protrusions 132 occupy openings 116*a* in the hinge pin 116, such as shown in the top, cross-sectional view of FIG. 11B. The hinge pin is rotationally fixed to the second hinge leaf 114, such as by using a boss, keyway, retaining pin, or other suitable structure so that the hinge joint 110 can be locked in the closed hinge position. In another example, the hinge pin 116 is a single piece with the second hinge leaf 114 or otherwise made so that the hinge pin 116 is rotationally fixed to the second hinge leaf 114. Thus, when protrusions 132 are positioned in the blocking position, rotational force applied to the first hinge leaf 112 would not result in rotation of the hinge pin 116.

In some embodiments, the locking mechanism 130 remains in the unlocked position so long as the hinge joint 110 is in an open hinge position or partially open hinge position. In this example, the inner wall 152 of the first hinge knuckle 118*a* defines recesses 154 only at positions corresponding to the closed hinge position. Thus, when the hinge joint 110 is open or partially open, the inner wall 152 of the first hinge knuckle 118*a* obstructs the protrusions 132 from moving to the blocking position. Upon moving the hinge joint 110 to a closed hinge position, such as shown in FIG. 11C, the protrusions 132 align with recesses 154 along the inner wall 152 of one of the first hinge knuckle 118*a*. Due to spring bias towards the locked position, the plunger 140 returns to the unlocked position (e.g., up position) and displaces the protrusions 132 into the recesses 154 where they interfere with opening the hinge joint 110. From the blocking position shown in FIG. 11C, the user can return the protrusions 132 to the non-blocking position by depressing the plunger 140, followed by moving the hinge joint 110 to the open hinge position as desired.

Note that in this example, the first hinge leaf 112 need not translate axially along the hinge pin 116 to disengage the hinge leaves 112, 114. As such, the locking mechanism 130 is the only locking mechanism in this example. Also, although two protrusions 132 are shown, more or fewer protrusions 132 can be used and the protrusion(s) 132 need not have a ball shape as illustrated. Further, although the protrusions 132 and recesses 154 are illustrated in the first hinge knuckle 118*a*, the location of these features can be in the second or third hinge knuckle 118*b*, 118*c*, between adjacent hinge knuckles 118, or in more than one of the hinge knuckles 118, as will be appreciated. Numerous variations and embodiments will be apparent in light of the present disclosure.

FIG. 12 shows another example of a hinge joint 110 with the locking mechanism 130 in a locked position. In this example, the actuator 134 is in a raised position and part of each protrusion 132 occupies the recess 154 in the inner wall 152 of the first hinge knuckle 118*a*, thereby blocking the first hinge leaf 112 from translating vertically along the hinge pin 116. In FIG. 13, the locking mechanism 130 has been moved to the unlocked position and the hinge leaves disengaged. The actuator 134 is depressed and the protrusions 132 have moved into the recesses 144 in the hinge pin 116. The first hinge leaf 112 has been lifted by the user along the hinge pin 116 so that the bottom edge portion 122 is disengaged from the slot 120 in the second hinge leaf 114 (shown in FIG. 13). In this condition, the first hinge leaf 112 can be rotated to an open hinge position.

FIG. 14 shows an example of the hinge joint 110 in an open hinge position, such as may occur when the hinge joint 110 is part of a rifle stock assembly and the stock is folded open along the side of the rifle. For example, the first hinge leaf 112 can be secured to a rifle stock and the second hinge leaf 114 can be secured to the proximal end of a rifle receiver (or other suitable structure). For example, fasteners (not shown) extending through the fastener openings 160 can secure to the receiver and stock to the hinge joint 110. In such an assembly, when the first hinge leaf 112 is opened, the stock would extend perpendicularly from the first hinge leaf 112 and would be folded along the right side of the rifle. Other embodiments can be constructed as a mirror image of this example where the stock folds along the left side of the rifle in the open hinge position. In yet other embodiments, the first hinge leaf 112 can be attached to the receiver and the second hinge leaf 114 secured to the rifle stock, as will be appreciated. Numerous variations and embodiments will be apparent in light of the present disclosure.

In this example, the actuator 134 is depressed so that the locking mechanism 130 is unlocked. Since the first hinge leaf 112 is in the open position, the protrusions 132 are oriented circumferentially along the inner wall 152 of the first hinge knuckle 118*a* rather than along the recess 154. The position of the protrusions 132 relative to the inner wall 152 and recess 154 is also shown in the top sectional view of FIG. 15, where the section is taken along a line as indicated in FIG. 14. In this open hinge position of the hinge joint 110, the locking mechanism 130 remains in the unlocked condition regardless of whether the first hinge leaf 112 is in the lower position (as shown in FIG. 14) or lifted along the hinge pin 116 to the upper position. This is because the protrusions 132 have been rotated to align with the smaller diameter of the inner wall 152 of the first hinge knuckle 118*a*, preventing a blocking position of the protrusions 132. Thus, to move the hinge joint 110 to the closed hinge position, the user need not unlock the locking mechanism 130 prior to disengaging the first and second hinge leaves 112, 114.

Compared to some embodiments discussed above, the protrusion(s) 132 in the embodiments shown in FIGS. 9-15 engage the first hinge knuckle 118*a* along the inner wall 152 of the first hinge knuckle 118*a* rather than at an upper end of the hinge knuckle 118*a*. In some such embodiments, the first hinge knuckle 118*a* advantageously protects the protrusions 132 from damage or debris since each protrusion 132 is overlapped by the first hinge knuckle 118*a* in both the locked and unlocked positions of the locking mechanism 130. Being contained between the plunger 140 and the inner wall 152 of the first hinge knuckle 118*a* also enables a greater range of movement for the protrusions 132 (e.g., balls) since the opening 116*a* in the hinge pin 116 need not be sized (although it can be) to prevent escape of the protrusions 132. Further, a tight fit between the inner wall 152 of the first hinge knuckle 118*a* and the hinge pin 116 can be used to prevent or reduce entry of dust, liquid, and other contaminants to the hinge joint 110.

In use, the hinge joint 110 as variously described herein can be used as part of a folding rifle stock assembly or other equipment that includes a hinge between various components. In one example, a rifle stock assembly including the hinge joint 110 has a rigid deployed position in which the first hinge leaf 112 engages the second hinge leaf 114. This engagement may involve the bottom edge of the first hinge leaf being received in the slot in the second hinge leaf 114. In some embodiments, the engagement between the first and second hinge leaves 112, 114 involves a catch 121 on one part engaging the catch recess 123 on the other part when the hinge joint 110 is in the closed position. In some such embodiments, the wedge formed between the sloping surfaces on the bottom edge portion 122 of the first leaf 112 and in the slot 120 of the second hinge leaf 114, the hinge joint 110 has reduced play (to zero or near zero) in the x, y, and z directions. To avoid inadvertently lifting the first hinge leaf 112 and disengaging it from the second hinge leaf 114, the hinge joint 110 may utilize a locking mechanism 130. When so equipped, the user must first depress the actuator 134 to unlock the locking mechanism 130. In the unlocked condition, the first hinge leaf 112 can be lifted along the hinge pin 116 relative to the second hinge leaf 114. For example, the user may lift the first hinge leaf 112 out of engagement with the second hinge leaf 114, and then may fold the rifle stock to a folded position along the side of the rifle.

In the folded position, the locking mechanism 130 can be configured to remain in the unlocked condition or revert to a locked condition. In one example, the hinge joint 110 is structured so that in the folded stock position (open hinge position), the first hinge knuckle 118*a* remains raised with respect to the second hinge leaf 114 and therefore does not return to the lowered or locked position. In its raised position, the first hinge knuckle 118*a* does not engage or lock with the second hinge knuckle and the protrusions 132 of the locking mechanism 130 are retained in the non-blocking position.

In one embodiment, the hinge joint 110 is structured so that the protrusions 132 are constrained to the unlocked (non-blocking) position so long as the hinge joint 110 is open at least some minimum amount (e.g., at least 45°), regardless of the relative vertical positions of the hinge leaves along the hinge pin 116. In one such embodiment, the first hinge leaf 112 may return to the lowered position with the base of the first hinge knuckle 118*a* engaging the second hinge knuckle 118*b*, when the hinge joint 110 is open.

In one embodiment, the first hinge leaf 112 can return to a lowered position upon rotation to about 180° (or other desired position). For example, the bottom portion of the first hinge knuckle has a wedge shape that engages a corresponding sloped surface on another part of the hinge when the hinge joint is moved to a particular open hinge position (e.g., 180°). In intermediate open hinge positions, the first hinge leaf 112 may maintain the raised position since the wedge profile on the bottom portion of the first hinge knuckle 118*a* does not enable it to readily occupy a lowered position. In one such embodiment, the first hinge leaf 112 returns to a lowered and engaged condition only when the rifle stock is folded to the side of the rifle (e.g., 180°) or in the deployed position (e.g., 0°). In some embodiments, the hinge joint 110 can also be configured so that the locking mechanism 130 may return to the locked condition only at these positions.

In other embodiments, the locking mechanism 130 does not return to the locked condition so long as the stock is partially or completely folded to an open position, and therefore would not require the user to unlock the locking mechanism 130 to deploy the stock. In such an example, the user need only depress the actuator 134 to unlock the locking mechanism 130 prior to moving the stock from the deployed position to a folded position.

In yet other embodiments, the locking mechanism 130 can resume the locked condition upon release of the actuator 134 at any time so long as the first hinge leaf 112 is in the lowered position. In some such embodiments, the first hinge leaf 112 can return to the lowered position at any rotational position where the engagement structures clear one another. In one example, the first hinge leaf 112 can return to the lowered position after rotating at least 30°, at least 45°, at least 90° or some other minimum amount of rotation from the closed hinge position.

Figure 16A:
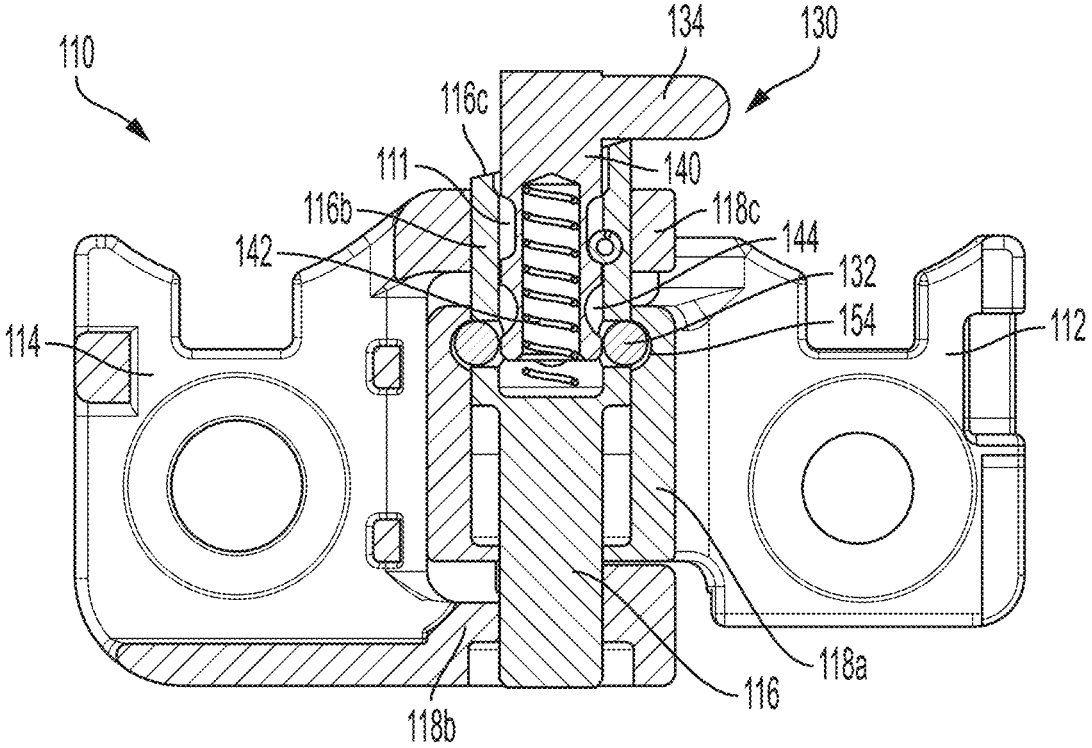
FIGS. 16A-16B illustrate cross-sectional views of a hinge joint with a locking mechanism in locked and unlocked positions, respectively, in accordance with an embodiment of the present disclosure.
Figure 16B:
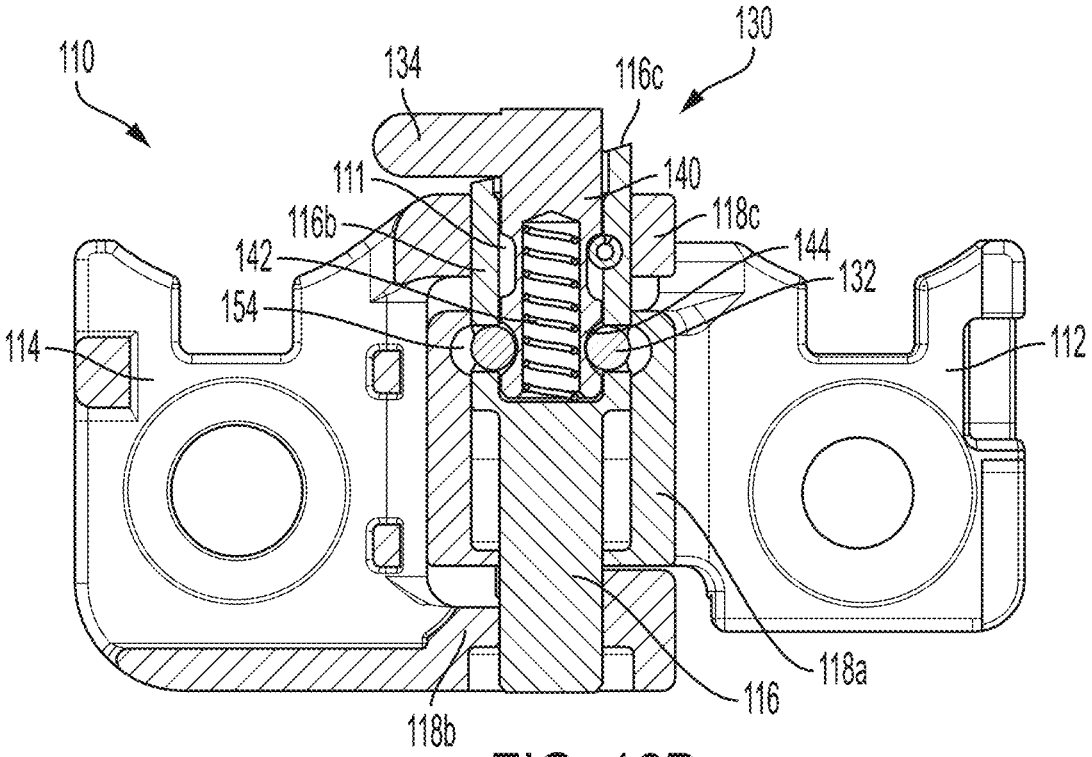

Referring now to FIGS. 16A-16B, cross-sectional views show a hinge joint 110 and locking mechanism 130 in an open hinge position, in accordance with another embodiment of the present disclosure. The hinge joint 110 includes first hinge leaf 112 and second hinge leaf 114 that can pivot about the hinge pin 116 between the open hinge position (shown) and a closed hinge position (shown, e.g., in FIG. 9). The first hinge leaf 112 includes a first hinge knuckle 118*a* located vertically between second and third hinge knuckles 118*b*, 118*c* on the second hinge leaf 114. The locking mechanism 130 includes a plunger 140 received in the hollow or void 111 of the upper portion 116*b* of the hinge pin 116. The plunger 140 can be raised or lowered within the void 111 by pressing on the actuator 134 at its top end. In this example, the actuator 134 and plunger 140 are configured as a cam-action plunger where the actuator engages a sloped upper surface 116*c* of the hinge pin 116. Rotating the plunger 140 using the actuator 134 causes the plunger 140 to raise or lower based on its position on the sloped upper end 116*c*. A spring 142 biases the plunger 140 to the locked position (e.g., raised position) by being compressed or at tension within the plunger 140 or in compression around the outside of the plunger 140, for example. In one embodiment, the spring 142 is compressed between the hinge pin 116 and the plunger 140. As with some embodiments discussed above, the plunger 140 defines one or more recesses 144 configured to receive part of the protrusions 132 (e.g., balls). When the locking mechanism 130 is in the locked condition (shown in FIG. 16A) the actuator 134 is in the raised position and the recesses 144 are misaligned with the protrusions 132, thereby causing protrusions 132 to occupy recesses 154 in the inner wall of the first hinge knuckle 118*a*. Accordingly, the protrusions 132 are in a blocking position that prevent raising the first hinge leaf 112 along the hinge pin 116.

FIG. 16B shows the hinge joint 110 after the actuator 134 has been rotated to the unlocked position. In the unlocked position, the recesses 144 in the plunger 140 are aligned with the protrusions 132 and allow the protrusions to recess radially into the hinge pin 116. In this non-blocking position, the protrusions 132 do not obstruct vertical movement of the first hinge knuckle 118*a* and the first hinge leaf 112 is ready to be lifted along the hinge pin 116. Note that even if the protrusions 132 do not freely move into the recess 144 (e.g., by gravity), initiating upward movement of the first hinge knuckle 118*a* along the hinge pin 116 will displace the protrusions 132 into the recesses 144. Although FIG. 16B shows the plunger 140 having a lowered position the unlocked position, the locking mechanism 130 can be arranged so that the unlocked position is the raised position, as will be appreciated.

Figure 17A:
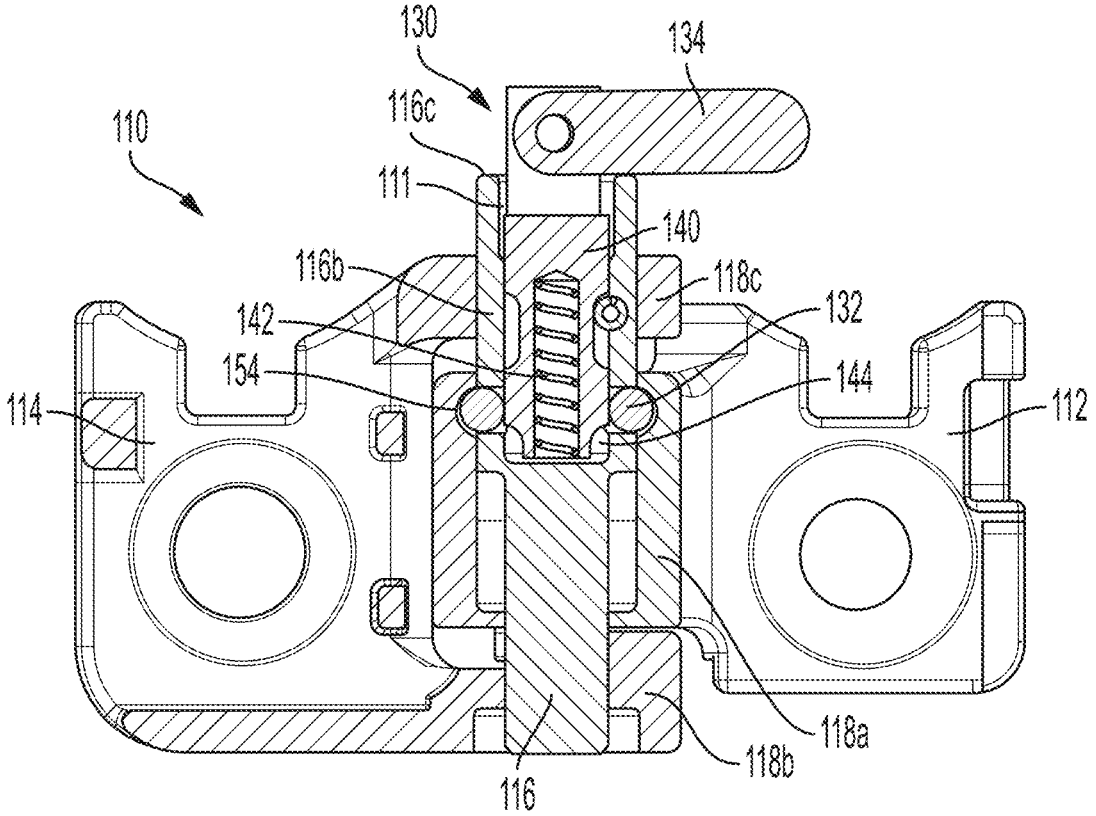
FIGS. 17A-17B illustrate cross-sectional views of a hinge joint with a locking mechanism in locked and unlocked positions, respectively, in accordance with an embodiment of the present disclosure.
Figure 17B:
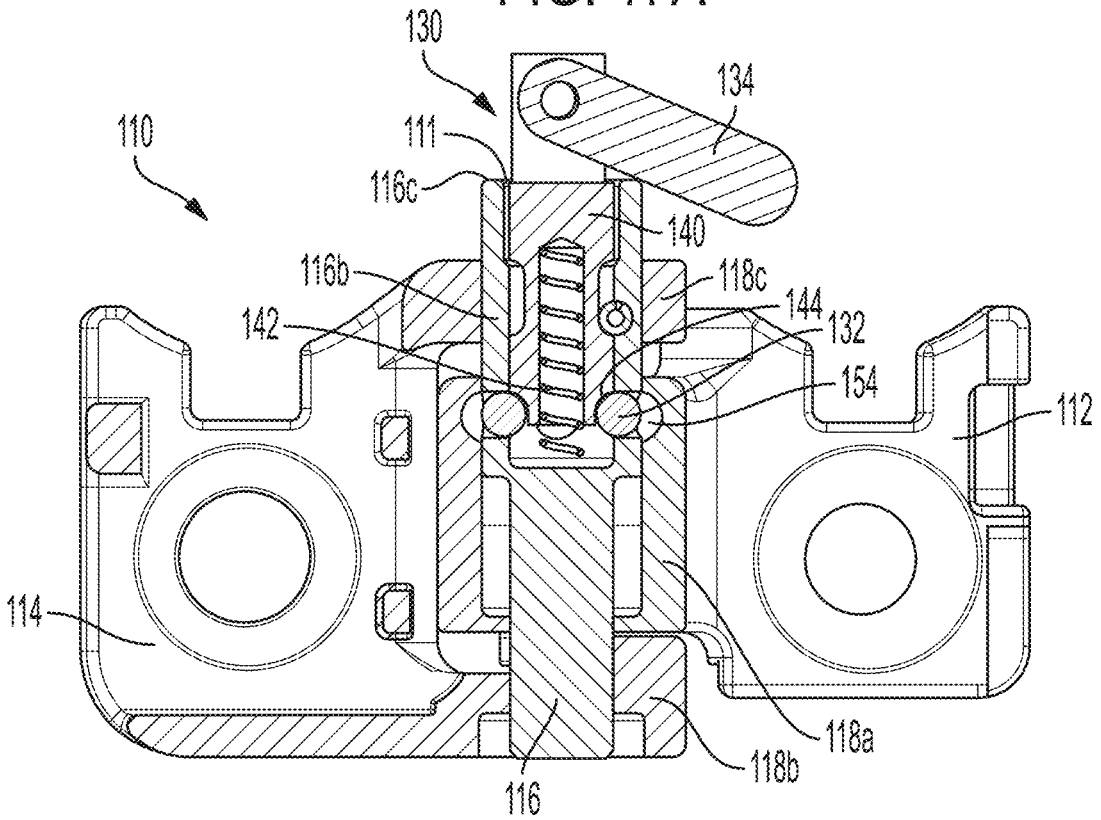

Referring now to FIGS. 17A-17B, cross-sectional views show a hinge joint 110 and locking mechanism 130 in an open hinge position, in accordance with another embodiment of the present disclosure. Similar to the embodiment of FIGS. 16A-16B, the hinge joint 110 includes first hinge leaf 112 and second hinge leaf 114 that can pivot about the hinge pin 116 between the open hinge position (shown) and a closed hinge position (shown, e.g., in FIG. 9). The first hinge leaf 112 includes a first hinge knuckle 118*a* located vertically between second and third hinge knuckles 118*b*, 118*c* on the second hinge leaf 114. The locking mechanism 130 includes a plunger 140 received in the void 111 of the upper portion 116*b* of the hinge pin 116. The plunger 140 can be raised or lowered within the void 111 by pressing on the actuator 134 at its top end. In this example, pressing down on the actuator 134 is pivotably connected to the plunger 140 and raises the plunger 140 by acting as a lever against the top surface 116 of the hinge pin 116. A spring 142 biases the plunger 140 to the locked position (e.g., raised position) by being at tension within the plunger 140 or in compression around the outside of the plunger 140, for example. As with some embodiments discussed above, the plunger 140 defines one or more recesses 144 configured to receive part of the protrusions 132 (e.g., balls). When the locking mechanism 130 is in the locked condition (shown in FIG. 17A) the actuator 134 is in the raised position and the recesses 144 are misaligned with the protrusions 132 so that the larger portion of the plunger 140 displaces the protrusions 132 outward to occupy recesses 154 in the inner wall of the first hinge knuckle 118*a*. Accordingly, the protrusions 132 are in a blocking position that prevent raising the first hinge leaf 112 along the hinge pin 116.

FIG. 17B shows the hinge joint 110 after the actuator 134 has been pushed downward the unlocked position. In the unlocked position, the plunger is raised so that the recesses 144 are aligned with the protrusions 132 and allow the protrusions 132 to recess radially into the hinge pin 116. In this non-blocking position, the protrusions 132 do not obstruct vertical movement of the first hinge knuckle 118*a* and the first hinge leaf 112 can be lifted along the hinge pin 116. Note that even if the protrusions 132 do not freely move into the recess 144 (e.g., by gravity), initiating upward movement of the first hinge knuckle 118*a* along the hinge pin 116 will displace the protrusions 132 into the recesses 144.

Figure 18:
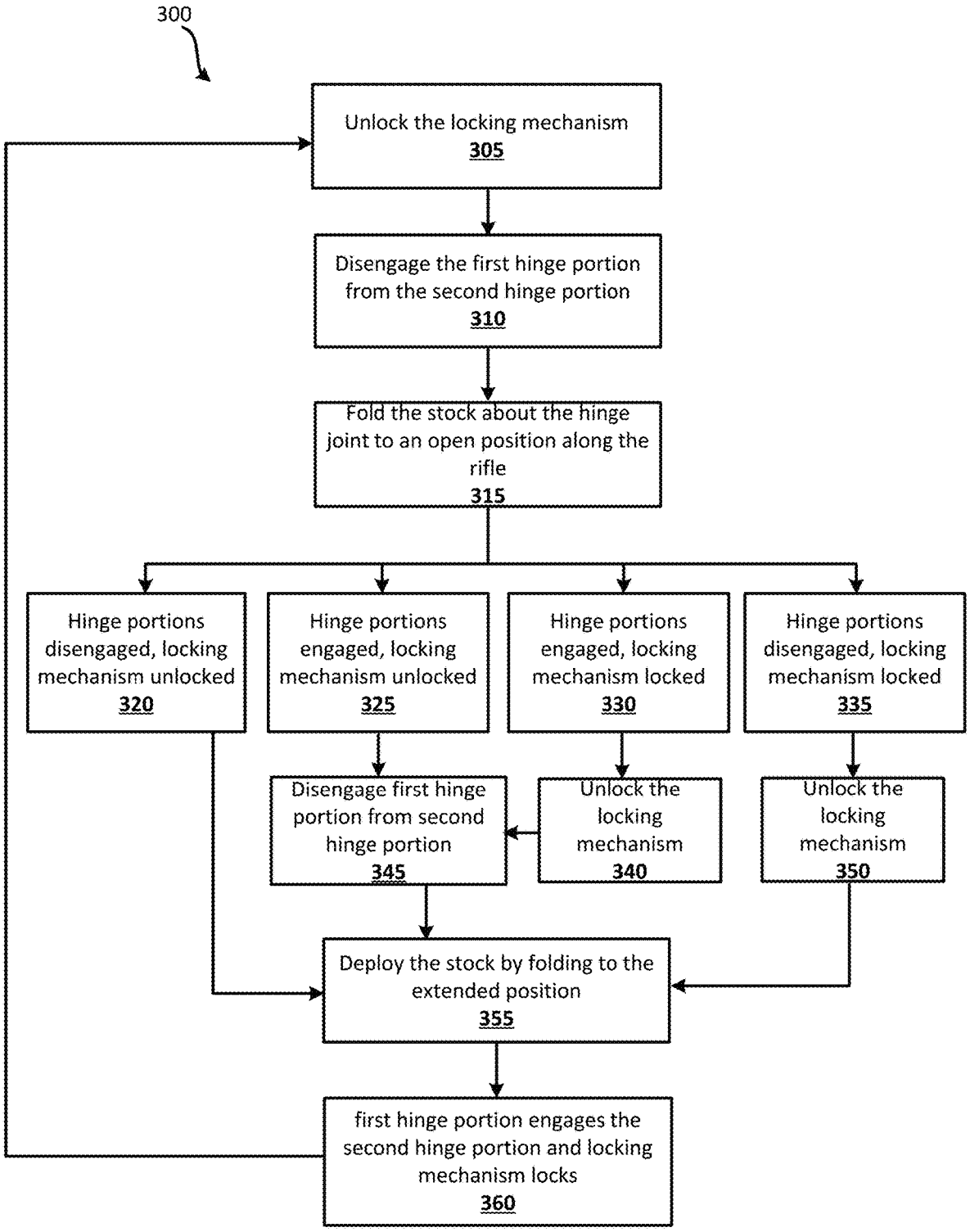
FIG. 18 is a flow diagram of a method of operating a folding stock equipped with a hinge joint with a locking mechanism, in accordance with some embodiments of the present disclosure.

Referring now to FIG. 18, a flow diagram illustrates a method 300 of operating a folding rifle stock, where the folding rifle stock has a hinge joint with an engagement structure between the hinge leaves and a locking mechanism, in accordance with some embodiments. In this example, the first hinge leaf of the hinge joint is secured to the stock and the second hinge leaf is secured to the rifle receiver (or a distal portion of the stock), such as shown in FIG. 1.

Method 300 is discussed from the arbitrary starting point of the rifle stock in a deployed position where the stock is extended and ready for use, the first hinge leaf engaging the second hinge leaf, and the locking mechanism in a locked condition. Method 300 can be performed in a repeating cycle, consistent with typical operation of a folding stock that is converted between folded and deployed positions, and interspersed with periods of storage or use, for example. Note, however, that method 300 can begin from any block in the flow diagram and can also end at any block in the flow diagram. Accordingly, method 300 need not complete an entire cycle nor a whole number of cycles. Note also that some blocks are optional in some embodiments and may not be performed at all. For example, in some embodiments, the hinge joint only has a locking mechanism (e.g., locking mechanism 130 as discussed above) where the hinge leaves do not engage one another. In such an embodiment, blocks 310, 325, 330, 340, and 345 would not be performed. Further, engagement between the first and second hinge leaves can be performed using structures discussed herein or with other suitable locking structures, as will be appreciated. Examples of hinge joints 110 suitable to perform the method 300 are discussed above with reference to FIGS. 1-17.

In accordance with one embodiment, method 300 begins with unlocking 305 the locking mechanism, which may be performed by depressing a button or plunger that is received in the hinge pin. In one embodiment, the user grasps the rifle stock by wrapping the fingers around the bottom of the stock and places the thumb on the button. The user can use the thumb to depress the button while using the hand to stabilize the stock and provide a counter force to the button.

Method 300 continues with disengaging 310 the first hinge portion from the second hinge portion. For example, the hinge joint includes a bottom edge portion on the first hinge leaf that is received in a slot defined in a corresponding location on the second hinge leaf. In some embodiments, the first and second hinge leaves alternately or also include a latch and latch recess, where the latch hooks into or otherwise engages the latch recess when the first hinge leaf is in the lowered and closed position. In other embodiments, portions of the hinge knuckles engage at certain hinge positions. In one example, the user's thumb continues to apply pressure to the button and maintain the locking mechanism in the unlocked condition, while lifting up on the stock to disengage 310 the first hinge portion from the second hinge portion.

Having disengaged the first hinge portion from the second hinge portion, method 300 continues with folding 315 the stock to an open position along one side of the rifle. In one example, the stock folds along the left side of the rifle, while in other embodiments the stock folds along the right side of the rifle. When the stock is folded, the locking mechanism may assume a locked condition or an unlocked condition. Similarly, the first and second hinge portions may re-engage one another when the stock is in the folded position. Accordingly, method 300 has four options based on the various positions of engagement and the locking mechanism.

In one embodiment, the portions of the hinge leaves or knuckles do not engage one another, and the locking mechanism remains unlocked while the stock is folded (block 320). In another embodiment, the hinge portions engage one another, and the locking mechanism remains unlocked (block 325), such as when the first hinge leaf (and stock) return to the lowered position and the base of the first hinge knuckle engages the second hinge knuckle. In yet another embodiment, the first hinge portion engages the second hinge portion and the locking mechanism returns to the locked condition (block 330). For example, springs in the hinge assembly bias the first hinge leaf downward to engage the second hinge leaf, and protrusions in the locking mechanism are biased to the blocking position. In yet another embodiment, the hinge portions remain disengaged and the locking mechanism returns to the locked condition (block 335).

In block 320, when the hinge portions are disengaged, and the locking mechanism is unlocked 320, method 300 continues with deploying 350 the stock by folding the stock to the extended position. If the hinge portions and the locking mechanism are not locked when the stock is folded, the stock may be deployed 355 without additional intervening action by the user.

In block 325, when the first hinge portion engages the second hinge portion, method 300 continues with disengaging 345 the first and second hinge portions followed by deploying 355 the stock by folding the stock to the extended position for use. Disengaging 345 the first and second hinge portions can be performed, for example, by lifting up on the stock to raise the first hinge leaf out of engagement with the second hinge leaf.

In block 330, when both the first hinge portion engages the second hinge portion and the locking mechanism is locked, method 300 continues with unlocking 340 the locking mechanism and then disengaging 345 the first and second hinge portions, followed by deploying 355 the stock to the extended position for use.

In block 355, when the hinge portions are disengaged, and the locking mechanism is locked, method 300 may continue with unlocking 350 the locking mechanism and then deploying 355 the stock to the extended position for use.

In block 360, the locking mechanism returns to the locked condition and the hinge portions return to the engaged position. For example, the first hinge leaf returns to a lowered position to engage and lock with the second hinge leaf, and protrusions in the locking mechanism return to a blocking position that prevents upward movement of the first hinge leaf relative to the second hinge leaf. From block 360 (e.g., after using the stock), method 300 may return to block 305 to unlock the locking mechanism.

Further Example Embodiments

The following examples pertain to further embodiments, from which numerous permutations and configurations will be apparent.

Example 1 is a hinge joint comprising a first hinge leaf with a first hinge knuckle; a second hinge leaf with a second hinge knuckle; a hinge pin extending through the first hinge knuckle and the second hinge knuckle, wherein the first hinge leaf is configured to pivot about the hinge pin relative to the second hinge leaf between a closed hinge position and an open hinge position, and wherein the first hinge leaf is movable axially along the hinge pin with respect to the second hinge leaf between a first axial position and a second axial position; a locking mechanism including (i) an actuator operable between a first position and a second position, and (ii) a protrusion movable between a blocking position and a non-blocking position in response to moving the actuator between the first position and the second position, respectively, wherein when the actuator is in the first position, the protrusion is in the blocking position and blocks axial movement of the first hinge leaf along the hinge pin, and when the actuator is in the second position, the first hinge leaf can move axially along the hinge pin with respect to the second hinge leaf.

Example 2 includes the subject matter of Example 1, wherein the locking mechanism is at least partially housed in one of the first hinge leaf or the second hinge leaf.

Example 3 includes the subject matter of Example 2, wherein the protrusion is positioned to engage the other of the first hinge leaf or the second hinge leaf to prevent axial movement of the first hinge leaf along the hinge pin.

Example 4 includes the subject matter of Example 1, wherein the locking mechanism is at least partially housed in the hinge pin.

Example 5 includes the subject matter of any of Examples 1 or 4, wherein the locking mechanism comprises a push-button plunger coaxially arranged within the hinge pin.

Example 6 includes the subject matter of Example 4, wherein when the protrusion is in the blocking position, the protrusion extends radially outward from the hinge pin to obstruct the first hinge knuckle from axial movement along the hinge pin.

Example 7 includes the subject matter of any of Examples 1-6, wherein the actuator is one of a push button or a lever.

Example 8 includes the subject matter of any of Examples 1-7, wherein the actuator is spring-biased to the first position.

Example 9 includes the subject matter of Example 4, wherein the hinge pin defines a hollow region extending axially into the hinge pin through an upper end of the hinge pin and defines a protrusion opening in a sidewall of the hinge pin, the locking mechanism comprising: a plunger received in the hollow region of the hinge pin, and the plunger defining a recess sized to receive at least part of the protrusion; wherein moving the actuator to the second position aligns the recess with the protrusion, and moving the actuator to the first position causes the protrusion to extend through the protrusion opening.

Example 10 includes the subject matter of Example 9, wherein the protrusion includes one or more balls.

Example 11 includes the subject matter of any of Examples 9 or 10, wherein the plunger is a push-button plunger.

Example 12 includes the subject matter of any of Examples 9-11, wherein the plunger is a cam action plunger.

Example 13 includes the subject matter of any of Examples 9-12, wherein the actuator is spring-biased to the first position.

Example 14 includes the subject matter of any of Examples 9-13, wherein in the blocking position, the protrusion is between the first hinge knuckle and the second hinge knuckle.

Example 15 includes the subject matter of Example 14, wherein in the blocking position, the protrusion is adjacent a top end of the first hinge knuckle.

Example 16 includes the subject matter of any of Examples 9-13, wherein in the blocking position, part of the protrusion is received in a recess defined along an inside of the first hinge knuckle.

Example 17 includes the subject matter of any of Examples 1-16, wherein pressing the actuator moves the locking mechanism to the unlocked position.

Example 18 includes the subject matter of any of Examples 1-17, further comprising a stock of a firearm, wherein the first hinge leaf is configured to be secured to a distal end of the stock and wherein the second hinge leaf is configured to be secured to the firearm.

Example 19 includes the subject matter of any of Examples 1-18, wherein when the hinge joint is in the closed hinge position and the first hinge leaf is in the first axial position, part of the first hinge leaf overlaps part of the second hinge leaf.

Example 20 includes the subject matter of Example 19, wherein a bottom edge of the first hinge leaf is received in a channel defined in the second hinge leaf when the hinge joint is in the closed hinge position.

Example 21 includes the subject matter of any of Examples 1-20, wherein when the hinge joint is in the closed hinge position and the first hinge leaf is in the first axial position, part of the first hinge knuckle overlaps part of the second hinge knuckle.

Example 22 includes the subject matter of any of Examples 20 or 21, wherein when the first hinge leaf is in the second axial position, the first hinge leaf is unobstructed from rotating to the open hinge position.

Example 23 includes the subject matter of any of Examples 1-18, wherein the first hinge leaf includes one of a catch and a catch recess and the second hinge leaf includes the other of the catch and the catch recess, the catch engaging the catch recess when the hinge joint is in the closed hinge position and the first hinge leaf is in the first axial position.

Example 24 includes the subject matter of any of Examples 1-23, wherein the locking mechanism is spring-biased to the locked position.

Example 25 is a folding rifle stock comprising the hinge joint of any of Examples 1-24.

Example 26 is a hinge joint comprising a first hinge leaf with a first hinge knuckle; a second hinge leaf with a second hinge knuckle; a hinge pin extending through and coaxial with the first hinge knuckle and the second hinge knuckle, the hinge pin defining a void extending axially into the hinge pin, and a sidewall of the hinge pin defining a protrusion opening, wherein the first hinge leaf can pivot about the hinge pin with respect to the second hinge leaf and wherein the first hinge leaf can translate along the hinge pin relative to the second hinge leaf; a plunger having a longitudinal plunger body and an actuator, the longitudinal plunger body received in the void and movable in the void between a first position and a second position, the longitudinal plunger body defining a protrusion recess; and a protrusion partially housed in the sidewall of the hinge pin at the protrusion opening; wherein when the plunger is in the first position, the plunger body displaces the protrusion to extend outward through the protrusion opening, thereby blocking rotational and/or axial movement of the first hinge knuckle; and wherein when the plunger is in the second position, the protrusion recess aligns with the protrusion opening to permit at least part of the protrusion to occupy the recess into the plunger body.

Example 27 includes the subject matter of Example 26, wherein the protrusion is a ball.

Example 28 includes the subject matter of Examples 26 or 27, wherein the protrusion is one of a plurality of protrusions movable between a blocking position and a non-blocking position.

Example 29 includes the subject matter of any of Example 26-28, wherein part of the protrusion is received in a recess along an inside of the first hinge knuckle when the plunger is in the first position.

Example 30 includes the subject matter of any of Examples 26-29, wherein when the hinge joint is in an open hinge position, the plunger is displaced into the recess in the plunger body by the first hinge knuckle.

Example 31 includes the subject matter of any of Examples 26-30, wherein the first hinge leaf is configured to translate axially along the hinge pin with respect to the second hinge leaf between a lower position and an upper position, and when the plunger is in the first position, the protrusion blocks axial movement of the first hinge leaf along the hinge pin.

Example 32 includes the subject matter of Example 31, wherein when the first hinge leaf is in the lower position, the plunger can be in either the first position or the second position and when the hinge leaf is in the upper position, the plunger can be only in the second position.

Example 33 includes the subject matter of Example 32, wherein the first hinge leaf can be in the lower position only when the hinge joint is closed.

Example 34 includes the subject matter of Example 32, wherein the first hinge leaf can be in the lower position when the hinge joint is closed and when the first hinge leaf is pivoted 180° from the second hinge leaf.

Example 35 includes the subject matter of any of Examples 26-34, wherein the plunger is biased to the first position.

Example 36 includes the subject matter of any of Examples 26-35, wherein the hinge joint is part of a folding rifle stock assembly including a buttstock, the first hinge leaf configured for attachment to the buttstock and the second hinge leaf configured for attachment to a firearm.

Example 37 includes the subject matter of Example 36, wherein the second hinge leaf includes a clamp configured for attachment to the firearm.

Example 38 is a method of operating a folding rifle stock having a hinge joint with first and second hinge leaves mounted on a hinge pin and a locking mechanism, the method comprising unlocking the locking mechanism to permit translation of the first hinge leaf along the hinge pin; translating the first hinge leaf along the hinge pin to disengage the first and second hinge leaves to permit rotation of the first hinge leaf about the hinge pin; and folding the stock to a folded position.

Example 39 includes the subject matter of Example 38, wherein unlocking the locking mechanism includes moving a protrusion to a non-blocking position and wherein translating the first hinge leaf includes raising the first hinge leaf along the hinge pin to a clearance position with respect to the second hinge leaf.

Example 40 includes the subject matter of any of Examples 38 or 39, wherein unlocking the locking mechanism includes depressing a button on the hinge joint.

Example 41 includes the subject matter of Example 40, wherein the button is part of a plunger movably received in the hinge pin.

Example 42 includes the subject matter of any of Examples 40 or 41, wherein depressing the button allows a protrusion partially housed in the hinge pin to assume a non-blocking position.

Example 43 includes the subject matter of any of Examples 38-42 and further comprises engaging a first hinge portion with a second hinge portion when the stock is in the folded position.

Example 44 includes the subject matter of Example 43, wherein engaging the first hinge portion with a second hinge portion includes lowering the first hinge leaf along the hinge pin with respect to the second hinge leaf.

Example 45 includes the subject matter of Example 44, wherein lowering the first hinge leaf causes a first tapered surface on a first hinge knuckle to engage a second tapered surface on a second hinge knuckle.

Example 46 includes the subject matter of any of Examples 38-45 and further comprises locking the locking mechanism when the stock is in the folded position.

Example 47 includes the subject matter of Example 46, wherein locking the locking mechanism includes lowering the first hinge leaf along the hinge pin with respect to the second hinge leaf.

Example 48 includes the subject matter of any of Examples 46 or 47, wherein locking the locking mechanism includes moving the locking mechanism to a locked position.

Example 49 includes the subject matter of any of Examples 46-48, wherein locking the locking mechanism includes releasing a button on the locking mechanism.

Example 50 includes the subject matter of Example 49, wherein releasing the button displaces a protrusion to extend radially outward from the hinge pin, thereby blocking translational movement of the first hinge leaf along the hinge pin.

Example 51 includes the subject matter of any of Examples 38-50 and further comprises folding the stock to a deployed position.

Example 52 includes the subject matter of Example 51 and further comprises disengaging the first and second hinge portions when the stock is in the folded position prior to folding the stock to the deployed position.

Example 53 includes the subject matter of any of Examples 51 or 52 and further comprises unlocking the locking mechanism when the stock is in the folded position prior to folding the stock to the deployed position.

Example 54 includes the subject matter of any of Examples 51-53 and further comprises engaging the first and second hinge leaves when the stock is in the deployed position.

Example 55 includes the subject matter of Example 54, wherein engaging the first and second hinge leaves includes lowering the first hinge leaf along the hinge pin with respect to the second hinge leaf.

Example 56 includes the subject matter of any of Examples 54 or 55, wherein engaging the first and second hinge leaves includes engaging a lower end portion of the first hinge leaf with a slot defined in the second hinge leaf.

Example 57 includes the subject matter of any of Examples 54-56, wherein engaging the first and second hinge leaves includes engaging a latch into a latch recess.

Example 58 includes the subject matter of any of Examples 51-54 and further comprises locking the locking mechanism when the stock is in the deployed position.

Example 59 includes the subject matter of Example 58, wherein locking the locking mechanism includes lowering the first hinge leaf along the hinge pin with respect to the second hinge leaf, thereby allowing the locking mechanism to assume the locked position.

Example 60 includes the subject matter of any of Examples 58 or 59, wherein locking the locking mechanism includes moving the locking mechanism to a locked position.

Example 61 includes the subject matter of any of Examples 58-60, wherein locking the locking mechanism includes releasing a button on the locking mechanism.

Example 62 includes the subject matter of Example 61, wherein releasing the button displaces a protrusion to extend radially outward from the hinge pin, thereby blocking translational movement of the first hinge leaf along the hinge pin.

The foregoing description of example embodiments has been presented for the purposes of illustration and description. It is not intended to be exhaustive or to limit the present disclosure to the precise forms disclosed. Many modifications and variations will be apparent in light of the present disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A hinge joint comprising:

a first hinge leaf with a first hinge knuckle;

a second hinge leaf with a second hinge knuckle;

a hinge pin extending through the first hinge knuckle and the second hinge knuckle, wherein the first hinge leaf is configured to pivot about the hinge pin relative to the second hinge leaf between a closed hinge position and an open hinge position; and a locking mechanism including:

an actuator operable between a first position and a second position; and a protrusion movable between a blocking position and a non-blocking position in response to moving the actuator between the first position and the second position, respectively;

wherein when the actuator is in the first position, the protrusion is in the blocking position and blocks movement of the first hinge leaf relative to the second hinge leaf.

2. The hinge joint of claim 1, wherein movement of the first hinge leaf includes axial movement along the hinge pin with respect to the second hinge leaf between a first axial position and a second axial position, wherein when the actuator is in the first position the protrusion blocks axial movement of the first hinge leaf along the hinge pin.

3. The hinge joint of claim 1, wherein the locking mechanism is at least partially housed in one of the first hinge leaf or the second hinge leaf and wherein the protrusion is configured to engage the other of the first hinge leaf or the second hinge leaf when the actuator is in the first position.

4. The hinge joint of claim 1, wherein the locking mechanism is at least partially housed in the hinge pin, and wherein the locking mechanism comprises a plunger coaxially arranged within the hinge pin, wherein in the blocking position, part of the protrusion is received in a recess defined along an inside of the first hinge knuckle.

5. The hinge joint of claim 4, wherein when the protrusion is in the blocking position, the protrusion blocks the first hinge leaf from pivoting about the hinge pin.

6. The hinge joint of claim 4, wherein when the protrusion is in the blocking position, the protrusion blocks axial movement of the first hinge leaf along the hinge pin.

7. The hinge joint of claim 1, wherein the hinge pin defines a void extending axially into the hinge pin through an upper end of the hinge pin, and further defines a protrusion opening in a sidewall of the hinge pin, the locking mechanism comprising:

a plunger received in the void, the plunger including the actuator on an upper end of the plunger and the plunger defining a protrusion recess sized to receive at least part of the protrusion when the protrusion is in the non-blocking position;

wherein moving the actuator to the second position aligns the protrusion recess with the protrusion and moving the actuator to the first position causes the protrusion to extend through the protrusion opening.

8. The hinge joint of claim 7, wherein the protrusion includes one or more balls.

9. The hinge joint of claim 7, wherein the actuator is one of a push-button or a lever.

10. The hinge joint of claim 7, wherein the actuator is spring-biased to the first position.

11. The hinge joint of claim 7, wherein when the protrusion is in the blocking position, the protrusion is between the first hinge knuckle and the second hinge knuckle.

12. The hinge joint of any of claim 1, further comprising a stock of a firearm, wherein the first hinge leaf is configured to be secured to a distal end of the stock and wherein the second hinge leaf is configured to be secured to the firearm.

13. The hinge joint of claim 1, wherein when the hinge joint is in the closed hinge position and the first hinge leaf is in the first axial position, part of the first hinge knuckle overlaps part of the second hinge knuckle.

14. A hinge joint comprising:

a first hinge leaf with a first hinge knuckle;

a second hinge leaf with a second hinge knuckle;

a hinge pin extending through and coaxial with the first hinge knuckle and the second hinge knuckle, the hinge pin defining a void extending axially into the hinge pin, and a sidewall of the hinge pin defining a protrusion opening, wherein the first hinge leaf can pivot about the hinge pin with respect to the second hinge leaf and wherein the first hinge leaf can translate along the hinge pin relative to the second hinge leaf;

a plunger having a longitudinal plunger body and an actuator, the longitudinal plunger body received in the void and movable in the void between a first position and a second position, the longitudinal plunger body defining a protrusion recess; and a protrusion partially housed in the sidewall of the hinge pin at the protrusion opening;

wherein when the plunger is in the first position, the plunger body displaces the protrusion to extend outward through the protrusion opening, thereby blocking movement of the first hinge knuckle; and wherein when the plunger is in the second position, the protrusion recess aligns with the protrusion opening to permit at least part of the protrusion to occupy the protrusion recess in the plunger body and to therefore permit movement of the first hinge knuckle.

15. The hinge joint of claim 14, wherein the first hinge leaf is configured to translate axially along the hinge pin relative to the second hinge leaf, and when the plunger is in the first position, the protrusion blocks axial movement of the first hinge leaf along the hinge pin.

16. The hinge joint of claim 14, wherein when the plunger is in the first position, part of the protrusion occupies a recess defined along an inside of the first hinge knuckle, thereby blocking movement of the first hinge knuckle.

17. The hinge joint of claim 16, wherein when part of the protrusion occupies the recess along the inside of the first hinge knuckle, the protrusion blocks the first hinge knuckle from pivoting about the hinge pin.

18. The hinge joint of claim 16, wherein when part of the protrusion occupies the recess along the inside of the first hinge knuckle, the protrusion blocks the first hinge knuckle from axial movement along the hinge pin.

19. The hinge joint of claim 14, wherein the plunger is spring biased to the first position.

20. The hinge joint of claim 14, further comprising a stock of a firearm, wherein the first hinge leaf is configured to be secured to a distal end of the stock and wherein the second hinge leaf is configured to be secured to the firearm.

* * * * *